US009175556B2

(12) United States Patent
Cherewyk et al.

(10) Patent No.: US 9,175,556 B2
(45) Date of Patent: Nov. 3, 2015

(54) FRACTURING FLUID DEFLECTING AND SCREENING INSERT

(71) Applicant: ISOLATION EQUIPMENT SERVICES INC., Red Deer (CA)

(72) Inventors: Boris (Bruce) P. Cherewyk, Calgary (CA); Edward Gerald St. George, Red Deer (CA)

(73) Assignee: ISOLATION EQUIPMENT SERVICES INC, Red Dear (CA)

( * ) Notice: Subject to any disclaimer, the term of this patent is extended or adjusted under 35 U.S.C. 154(b) by 336 days.

(21) Appl. No.: 13/896,982

(22) Filed: May 17, 2013

(65) Prior Publication Data

US 2013/0306304 A1 Nov. 21, 2013

Related U.S. Application Data

(60) Provisional application No. 61/649,111, filed on May 18, 2012, provisional application No. 61/665,101, filed on Jun. 27, 2012.

(51) Int. Cl.
*E21B 43/26* (2006.01)
*E21B 33/068* (2006.01)

(52) U.S. Cl.
CPC ..... *E21B 43/26* (2013.01); *E21B 33/068* (2013.01)

(58) Field of Classification Search
CPC ..... E21B 43/26
See application file for complete search history.

(56) References Cited

U.S. PATENT DOCUMENTS

| | | | | |
|---|---|---|---|---|
| 5,380,434 | A * | 1/1995 | Paschedag | 210/360.2 |
| 2008/0035326 | A1 * | 2/2008 | Cherewyk | 166/75.13 |
| 2010/0236782 | A1 * | 9/2010 | Bruegger | 166/301 |

* cited by examiner

*Primary Examiner* — William P Neuder
(74) *Attorney, Agent, or Firm* — Goodwin Law; Sean W Goodwin

(57) ABSTRACT

Fracturing headers and connected conduits are fit with one or more fluid screening and wear minimizing inserts. Tubular screen inserts are provided to screen a flow of fracturing fluid through manifolds prior to, or at, the fracturing header. Each tubular screen insert has a tubular wall having an insert bore, an endwall and an open inlet. A plurality of openings, about the tubular wall, provide fluid communication between the bore and an annular area outside the wall. Oriented in a flow conduit with the closed endwall upstream, the insert excludes and sheds debris therefrom. Oriented with the closed endwall downstream, the insert receives and stores debris. Pairs of inserts, retained in opposing inlet ports, serve to screen fluid and deflect erosive flow from tools such as coil tubing extending therethrough. A fracturing block fit with opposing inlet ports can also be fit with an outlet port for flowback operations.

36 Claims, 25 Drawing Sheets

FRACTURING FLUID DEFLECTING AND SCREENING INSERT

CROSS REFERENCE OF RELATED APPLICATIONS

This application claims the benefits under 35 U.S.C 119(e) of U.S. Provisional Application Ser. Nos. 61/649,111, filed May 18, 2012, and 61/665,101 filed on Jun. 27, 2012, which are incorporated fully herein by reference.

FIELD

The present disclosure relates to fracturing operations and the delivery of frac fluid to a wellbore. More particularly, one or more screens are provided in the supply lines and other equipment en-route to the wellhead for removing debris.

BACKGROUND

It is known to conduct fracturing or other stimulation procedures in a wellbore by isolating zones of interest, (or intervals within a zone), in the wellbore, using packers and the like, and subjecting the isolated zone to treatment fluids, including liquids and gases, at treatment pressures. In a typical fracturing procedure for a cased wellbore, for example, the casing of the well is perforated to admit oil and/or gas into the wellbore and fracturing fluid is then pumped into the wellbore and through the perforations into the formation. Such treatment opens and/or enlarges drainage channels in the formation, enhancing the producing ability of the well. For open holes that are not cased, stimulation is carried out directly in the zones or zone intervals.

The fracturing operations include a variety of downhole tools that include relatively fine tolerances for operation including shifting sleeves, ports and ball seats. The fluid arriving downhole should be free of solids or debris which could interfere with the tools.

Normally the fluids are solids free or intentionally contain specific and acceptable solid particulates such as frac sand and proppent. Unfortunately, reality is such that debris can also enter the system at the supply side including equipment breakdown or introduced during assembly. Equipment can include pumps and blenders with moving components subject to component wear and castoffs which can enter the fluid stream. Examples of some of the components that can enter the fluid stream include parts of turbine wheels, seals, seat retainers, check valve flappers, and union seals. Further, in the on-site coupling of frac fluid supply lines, debris such as mud and gravel, can be inadvertently introduced.

SUMMARY

Debris and undesirables are screened out of frac fluids en-route downhole to fracturing tools in a wellbore. Debris might include pumper or frac line pieces, seals and/or road gravel. At times the debris is pumped into the well and it interferes with downhole equipment such as packers as part of Mongoose™ Jet Frac System (by NCS Energy Services, Inc.) The downhole equipment has all types of sliding sleeves, activating and deactivating gadgets and their performance can be compromised by debris jamming and getting stuck in the mechanism. A coil header, or frac head adapted to accept coil tubing, is used to protect the coil during the pumping operation down the annulus. A zone or stage in zone is stimulated, the packer jaws are deactivated and the packer tool is raised or lowered to the next desired stage and the jaws are activated and another stimulating is performed. This continues until all the desired stages are completed. A screening device is required to prevent undesirable debris from being pumped into the well that can compromise the mechanics of the tool and or plug the jetted port into the formation.

Herein, several screening embodiments are employed alone or in combination, such as to screen a flow of fracturing fluid in a manifold or equalization header prior to the fracturing header, screening fluid immediately at the fracturing header, or at the exit of the header to the wellbore.

Generally a tubular screen insert is provided having a tubular wall having an insert bore, an endwall and an open end or inlet. A plurality of openings about the tubular wall provide fluid communication between the bore and an annular area outside the wall.

The screen insert can be oriented in a flow conduit with the closed endwall upstream, for shedding debris and passing screened fluid. The screen insert can be oriented with the closed endwall downstream, in a basket orientation, for receiving and storing debris and passing screened fluid.

The basket form of screen insert is particularly amenable for securing in the inlet ports of a fracturing block in a fracturing header, each insert fit to opposing inlet ports in the block. The inserts are retained in the block, such as by sandwiching an insert flange between the block and connecting conduits, such as a connecting flange of an isolation valve or piping.

Accordingly, in one aspect, apparatus is disposable in a fluid conduit between a source of a flow of fracturing fluid and a wellbore for excluding debris, the apparatus having a tubular wall defining a screen bore extending longitudinally therethrough and a plurality of openings spaced about a circumference of the tubular wall excluding debris entrained within the flow of fluid while permitting the fracturing fluid to pass therethrough between the screen bore and an annular flow area about the tubular wall. The bore has a closed endwall for blocking the screen bore and directing fluid through the plurality of openings substantially free of the debris. The bore also has an open end for flow of fluid between screen bore and the fluid conduit.

The apparatus is useful in the context of a fracturing block for a fracturing header for delivering fracturing fluid to a wellbore. The block as a main bore contiguous with the wellbore; and at least two opposing inlet ports in fluid communication with a main bore in communication with the wellbore. Each inlet port receives a flow of fluid from a connecting conduit and discharges the fluid to the main bore for delivery to the wellbore. Each inlet port has a screen insert fit thereto.

In another aspect, a fracturing header is provided using the above fracturing and further comprising a flowback outlet port wherein the fracturing block comprises two opposing inlet ports for receiving the flow of fluid from the connecting conduit; and the flowback outlet port is in communication with the main bore for discharging flowback fluid from the main bore.

In another aspect a system is provided for delivering fracturing fluid, substantially free of debris to a wellbore, comprising providing a fracturing block having a main bore connected to the wellbore and two or more fluid inlet ports for receiving fracturing fluid therein; and a screen insert fit to each of the two or more inlet ports. The system can further comprise an equalization header or manifold for supplying fracturing fluid to the two or more inlet ports. The equalization header can further comprise two or more screen inserts fit to each of two or more discharge outlets to the fracturing header.

In another aspect, a multipurpose block for a fracturing header is provided including inlet ports for a flow of fracturing fluids and at least one outlet port for flowback. The flowback block is fit with a wear sleeve across the interface between the block and connecting conduit. More particularly a fracturing header for a wellbore is provided comprising a multipurpose block having a main bore in communication with the wellbore, the multipurpose block further comprising two or more inlet ports disposable in opposing pairs and in communication with the main bore; and flowback outlet ports in communication with the main bore for receiving a flow of fluid from the main bore.

BRIEF DESCRIPTION OF THE DRAWINGS

FIGS. 16A through 18B illustrate various optional screen insert and block interfaces, namely:

FIG. 16A illustrates a main block inlet port having an annular recess forming a seat against which a shoulder on the insert bears;

FIG. 18B illustrates a main block inlet port having an annular recess forming a seat against which a finite and radially extending shoulder on the insert bears;

DESCRIPTION

Figure 1:
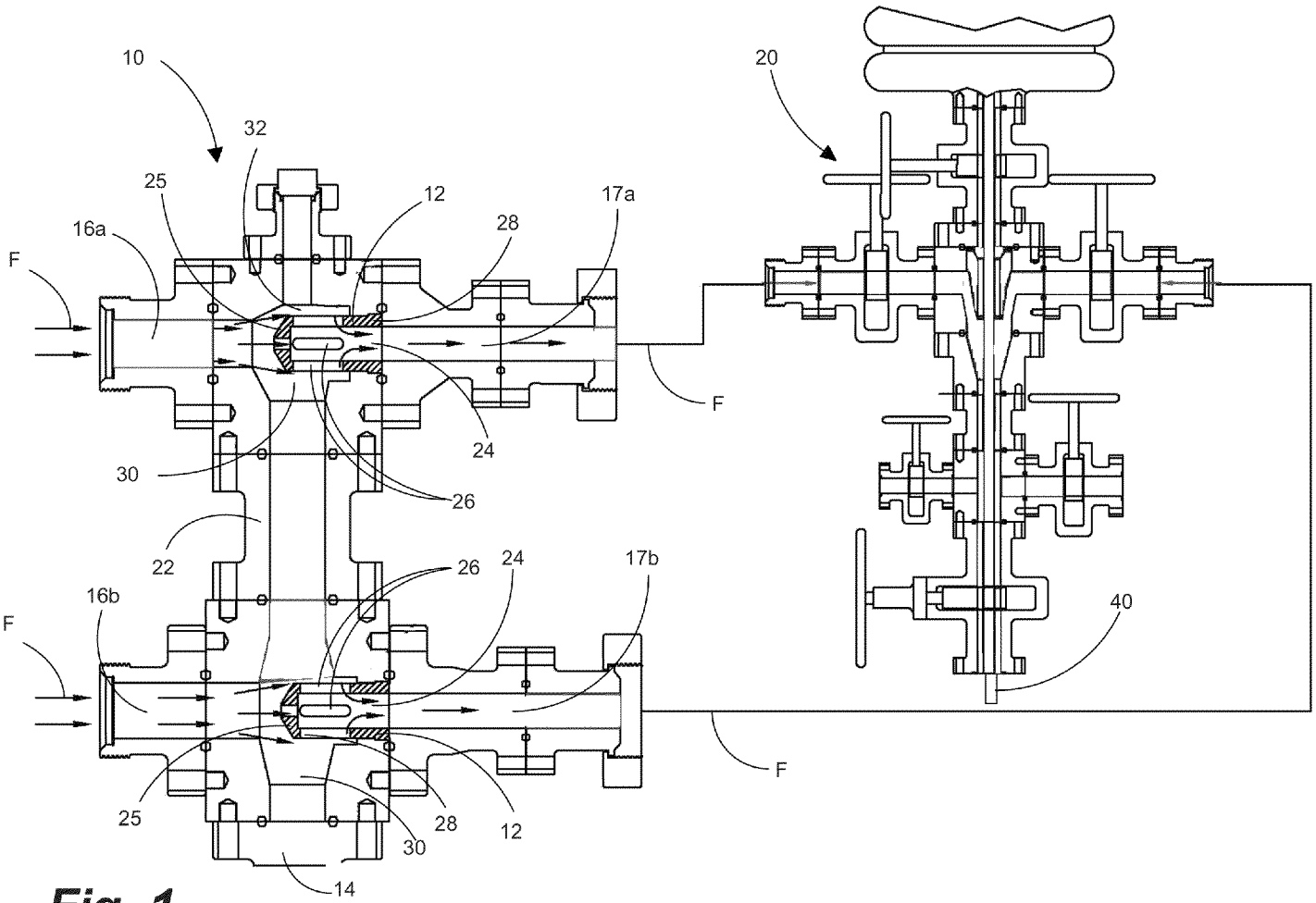
FIG. 1 illustrates cross-sectional view of a system in which an equalizing header distributes fracturing fluid to a main block of a fracturing header the block fit with a deflecting sleeve for minimal impact on coil tubing extending therethrough, the equalizing header being fit with embodiments of screens inserts to prevent transport of debris and the like to the fracturing head and downhole into a wellbore.

As shown in FIG. 1, a fracturing operation can include various connections for delivering fracturing fluid to a coil head, buffalo head, frac head or fracturing header as termed herein. The fracturing head distributes fracturing fluid, including proppent for transport down a wellbore. A fracturing header typically includes a fracturing block that has multiple inlet ports for distributing a high rate of flow and erosive fracturing fluid thereto. A flow block can be included for discharging flowback after a fracturing operation. As shown, one or more connecting piping, frac iron or conduits can be routed to the fracturing header. Further, flow of fluid to two or more of the inlet ports of the fracturing header can be equalized between various fracturing fluid sources using an equalization header.

All of the above components provide opportunities to introduce means for excluding debris. Herein, various inserts can be provided, depending on the environment, to screen fracturing fluids delivered down a wellbore and further to reduce the energy of the erosive flow before contacting tools and coil tubing, tool-conveyance strings.

As shown in FIGS. 1 to 4, one or more of these connections can include a screen insert according to embodiments disclosed herein. Due to the erosive nature of the fluid, it is a general objective to minimize or avoid local increases in the fluid velocity. Hence, screen inlet and outlets are maximized with the constraints of the particular environment. In some embodiments, the screen insert have flow passages generally equal or greater in cross sectional flow area than are the flow areas of supply and discharge equipment or components themselves.

Figure 2:
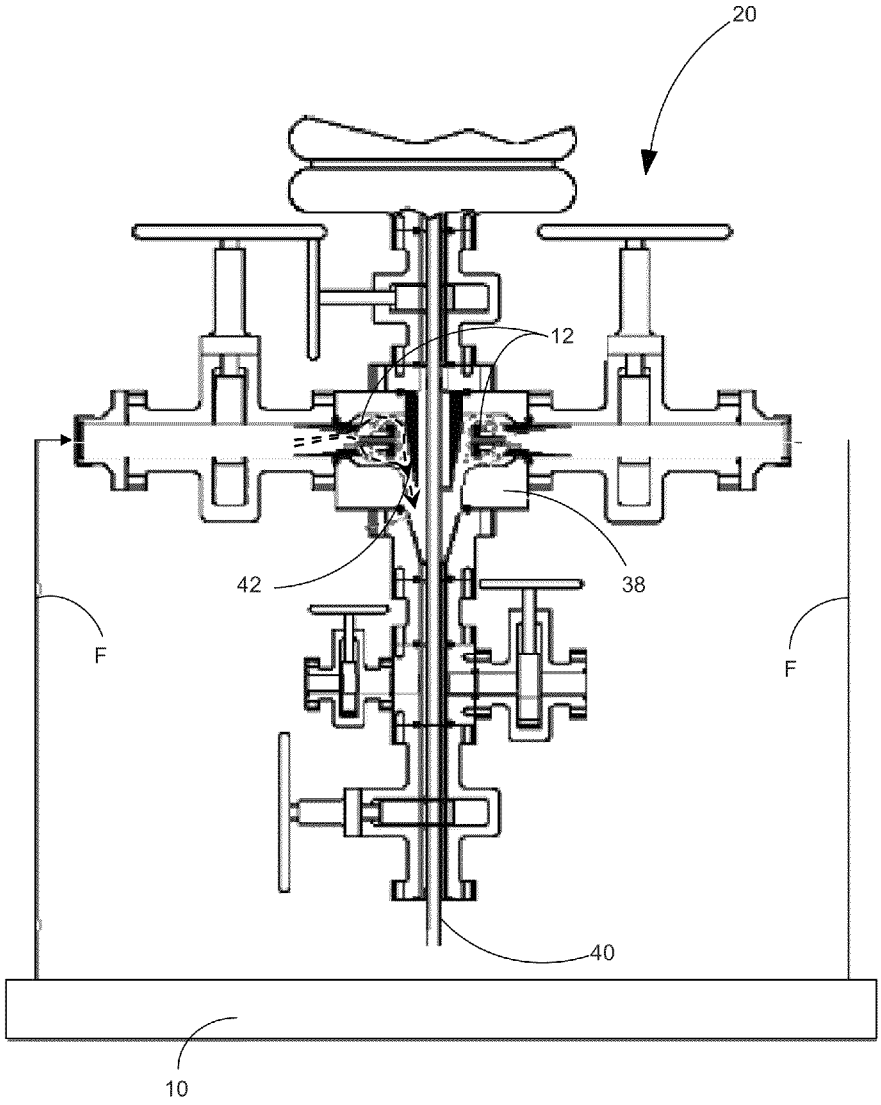
FIG. 2 is cross-sectional view of a fracturing header, the main block being fit with a main tapered deflecting sleeve and screening inserts fit to opposing inlet ports according to another embodiment, the screens inserts further minimizing erosive impact on coil tubing extending therethrough.

Further, the components, such as fracturing headers, equalization headers and the like, can be manufactured to complement the screen inserts and best screen and distribute the flow of fracturing fluid. As shown, the equalization header is upstream of the fracturing header and distributes flow to each of the two or more inlet ports of the fracturing header. In FIG. 2, the equalization header is formed with a bore and the inserts oriented and mounted for blocking yet shedding debris and enabling periodic removal. In the case of a fracturing header, the screen inserts are oriented for capturing debris, the screen inserts and header block working together to deflect flow from any tool passing therethrough and even reduce flow velocity. In fracturing headers with main bore deflector sleeves, so as to protect coil tubing passing therethrough, the inclusion of screen inserts in the fluid inlet ports enhances the sleeve's protection. In other embodiments, use of the screen inserts can obviate the need for a deflector screen at all.

Returning to FIG. 1, in the case of an equalization header 10, one can provide a screening embodiment comprising a protruding screen insert 12, rejecting debris from entering the protruding screen insert 12, such debris being recovered in at a cleanout 14 for periodic removal of excluded debris.

As shown, the cleanout 14 is a blind flange, but embodiments can also include a fluid lock section sandwiched between a first valve and a second block valve, forming a recovery chamber therebetween, for on-the-fly access and cleanout. The recovery chamber would have a bleed port for reducing pressure therein before servicing.

In detail, the equalization header 10 includes a block having two or more supply inlets 16*a*,16*b*, from two or more fluid sources, two or more discharge outlets 17*a*,17*b* to a fracturing header 20, and a cross passage 22 for fluid flow equalization between the supply inlets 16*a*,16*b*. A protruding screen insert 12 is fit to one or more of the discharge outlets 17*a*,17*b*. Each protruding screen 12 comprises a screen body or insert having a bore 24 in communication with its respective discharge outlet 17*a*,17*b*. The screen bore 24 has a transverse endwall 25, which is substantially a closed endwall, forcing the majority of the fracturing fluid to pass through one or more openings 26,26 . . . generally formed along a tubular wall 28 of the screen insert. Openings can be optionally formed in the closed endwall 25. The openings 26 fluidly connect the insert bore 24, and open end 27, and outlets 17*a*,17*b* with the supply inlet or inlets 16*a*,16*b*. For maximizing the cross-sectional flow area into the inserts 12, the one or more openings 26 are circumferentially spaced about the tubular wall 28. The openings, provided about the circumference, can each be sized to maximize flow therethrough yet to exclude pre-determined characteristics of known debris, and yet remain sufficiently supported structurally in the insert 12 overall. In this projecting form of screen insert 12, the circumferentially arranged openings 26 also conduct fluid to collide in the bore 24, absorbing the energy in turning the fluid from a generally radial, incoming vector to an axial vector along the bore 24 to the outlet 17*a* or 17*b* respectively.

The openings 24 are formed through the wall 28 of the insert 12. Each opening 26, from the wall's exterior, inward to the openings interior, can be profiled to minimize flow disruption. A screen insert 12 is fit to each of the two or more discharge outlets 17*a*,17*b*, each insert 12 comprising the tubular wall 28 and the insert bore 34 extending longitudinally therethrough, the insert bore 24 having the upstream endwall 25 thereacross and an open downstream fluid outlet or open end 27 in fluid communication with a respective inlet port of the fracturing header 20, the plurality of slot-like openings 26 spaced circumferentially about and extending through the tubular wall 28 for screening the flow of fluid to the fracturing header 20.

For a block structure like the equalizing header 10, an internal flow bore 30 is sized to provide generally unrestricted fluid access to the screen insert, and as shown, an annular flow area 32 is provided about each screen insert 12 as the bore 30 narrows thereabout. Thus, fluid flow in the annulus 32 can be determined to be at a velocity about equal to or at a lower than that in the supply line 16*a*, further entering the insert's openings at sub-supply velocities, and also can flows through the insert's bore 24 at sub-supply velocities.

Each insert 12 can be provided with an upset at the downstream end for fitting with a corresponding annular recess in the header at the interface with downstream connectors, such as flanged outlets 17*a*,17*b*. In other words, the insert 12 is inserted into the header discharge outlet 17*a*,17*b*, the upset fitting and seating into the annular recess, and downstream valves, blocks, or adapters sandwich the screen securely into the equalization header 10.

As suggested above, additional flow area through a closed endwall 25 of screen insert 12 can be provided by one or more additional openings 26, admitting fluid through the substantially closed endwall to comingle with the fluid admitted through the circumferentially-arranged openings.

The protruding screen 12 in the equalization header environment can be located at any other suitable point of connection along the fracturing fluid supply conduit.

As shown in FIGS. 2 through 4, in the environment of the fracturing header 20, the screen inserts 12 are fit to inlet ports of a main block 38 of the header 20 and can be oriented in the form of a basket for collecting debris and for dispersing fluid in a radially outward pattern. Typically, for low profile blocks, each inlet port is located as a side port, arranged substantially perpendicular to the main bore. As a fracturing header basket screen insert 12 is not readily self-cleaning, it is advantageous, for maximizing time between servicing, to have a pre-screen in an equalization header 10 or other upstream location.

The fracturing header might also be equipped with a supplemental deflector sleeve for protecting coil tubing inserted therethrough. A discussion of an angled form of deflector sleeve is set forth in Applicant's U.S. Pat. No. 8,122,949, issued Feb. 28, 2012. Further the screen insert 12 can have a blank or closed endwall which deflects the flow of fluid generally radially, thereby minimizing direct erosive contact with components in the bore such as coil tubing. In other instances, depending on screen configuration and flow rates, and particularly at low pumping rates, one can avoid the use of a deflector sleeve, and rely on the inserts alone for protecting such components.

The fracturing header basket screen insert 12 is also a tubular screen. As described in detail later, the insert 12 has a bore in communication with a supply of fracturing fluid, such as an equalizing header 10, and again has one or more openings formed along the tubular wall for fluidly connecting the insert bore with the fracturing header bore for conducting fluid downhole to the downhole tools.

The screens inserts 12 distribute fluid flow radially for preventing direct impingement of the fracturing fluid with tools passing therethrough such as coiled tubing 40. As shown in FIG. 2, a deflector sleeve 42 can also be fit coaxially to the main block 38 and is used to protect the coil tubing 40.

Figures 3A, 3B:
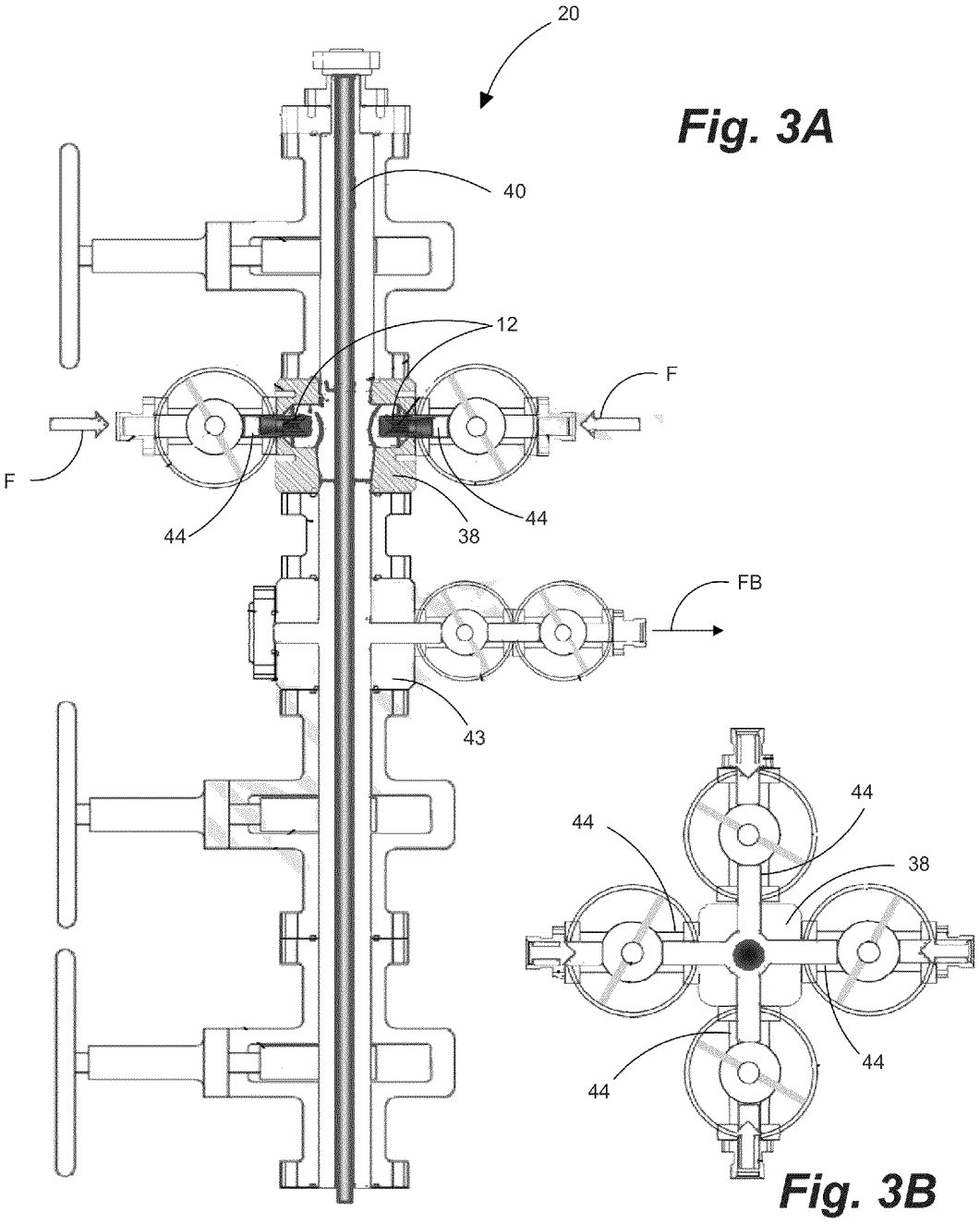
FIG. 3A is cross-sectional view of a fracturing header, the main block being absent a main bore deflecting sleeve but being fit with opposing screening inserts according to another embodiment.
FIG. 3B is a partial plan and cross-section view of the fracturing header illustrating four inlet ports, in pairs of opposing inlets.

As shown in FIG. 3A, the screens inserts 12 distribute fluid flow radially for preventing direct impingement of the fracturing fluid with the coil tubing 40 and a deflector sleeve is not even used, maximizing the size of fracturing header bore for passing tools therethrough. A separate flowback block 43 can be provided adding about 30 inches to the height of the fracturing header 20. As shown in FIG. 3B, the main block 38 of the fracturing header 20 can comprise four inlets 44,44,44,44

Figure 4A:
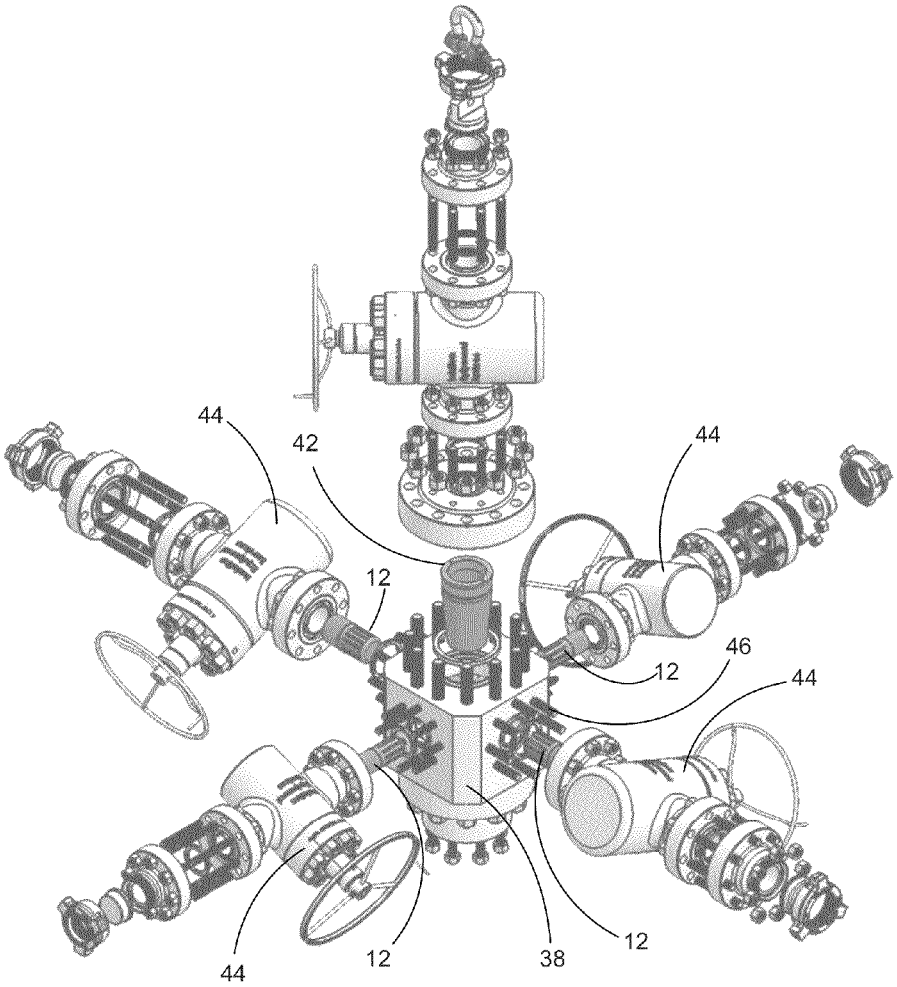
FIG. 4A is an exploded, perspective view of a fracturing header having four opposing inlet ports, each fit with a screen insert, the main bore of the fracturing block also fit with a main deflector sleeve.

As shown in FIG. 4A, the fracturing header 20 comprises a main block 38 having a plurality of inlet ports 46, four shown, a plurality of inlets 44 each connected to an inlet 46 and a screen insert 12 for each inlet port 46.

Figure 4B:
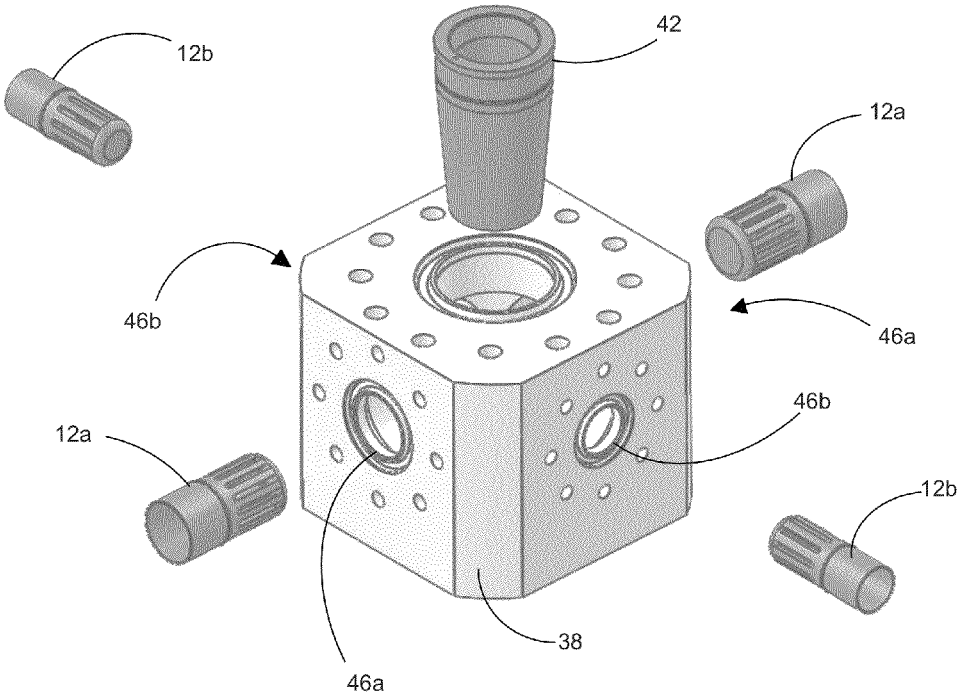
FIG. 4B is a perspective view of a main block with pairs of inserts in exploded view therefrom, one pair of opposing nominal 4 inch sleeve inserts and one pair of opposing nominal 3 inch sleeve inserts.

With reference to FIG. 4B, the main block 38 of FIG. 4A is illustrated free from all connecting equipment. The block 38 is fit with a deflector sleeve 42, and two pairs of screen inserts 12. A first pair of inserts 12*a*,12*a* are fit to opposing first inlet ports 46*a*,46*a*, and a second pair of inserts 12*b*,12*b* are fit to opposing second inlet ports 46*b*,46*b*.

In FIGS. 5A to 9B a fracturing header 20 is shown fit with a deflector sleeve 42 and two or more screen inserts 12,12 . . . .

Figure 5B:
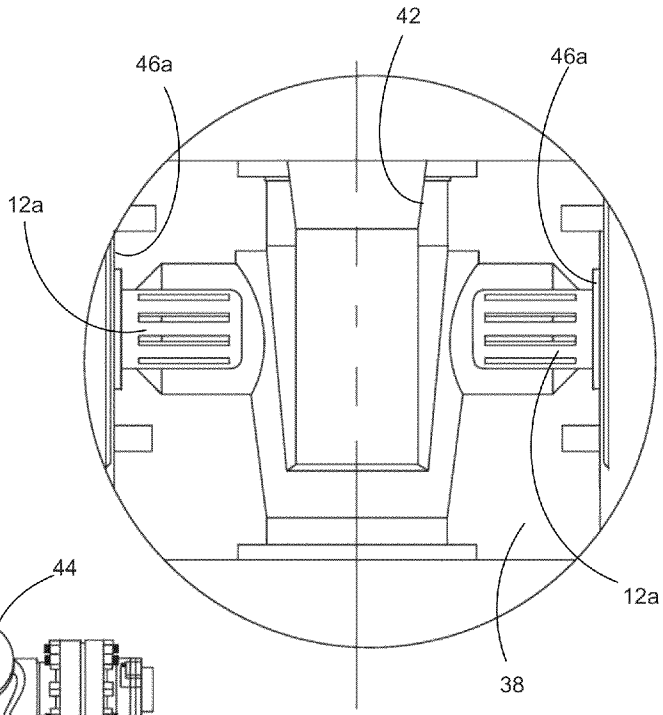
FIG. 5B is an enlarged view of the circled area of the main bore showing the main bore sleeve and the two inserts.
Figure 5A:
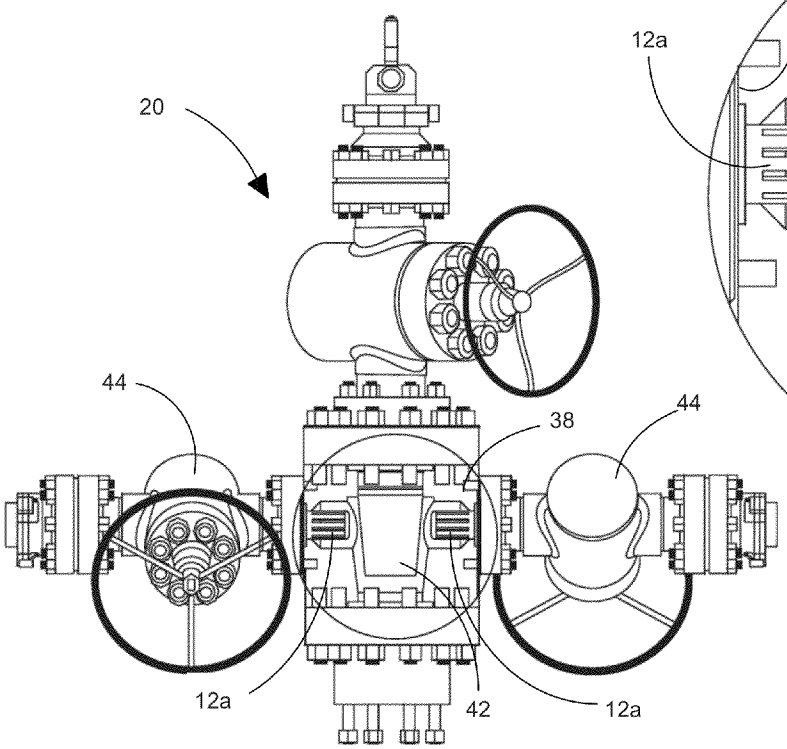
FIG. 5A illustrates a side view of a fracturing header with a main block shown in cross-sectional view, the main block fit with two opposing inlet ports and isolation valves fit to each port, the main bore having a deflecting sleeve fit thereto for protecting coil tubing passing therethrough.

Turning to FIGS. 5A and 5B, a fracturing header 20 is shown fit with a first pair of screen inserts 12*a*,12*a* to a first pair of inlet ports 46*a*,46*a*.

Figure 6A:
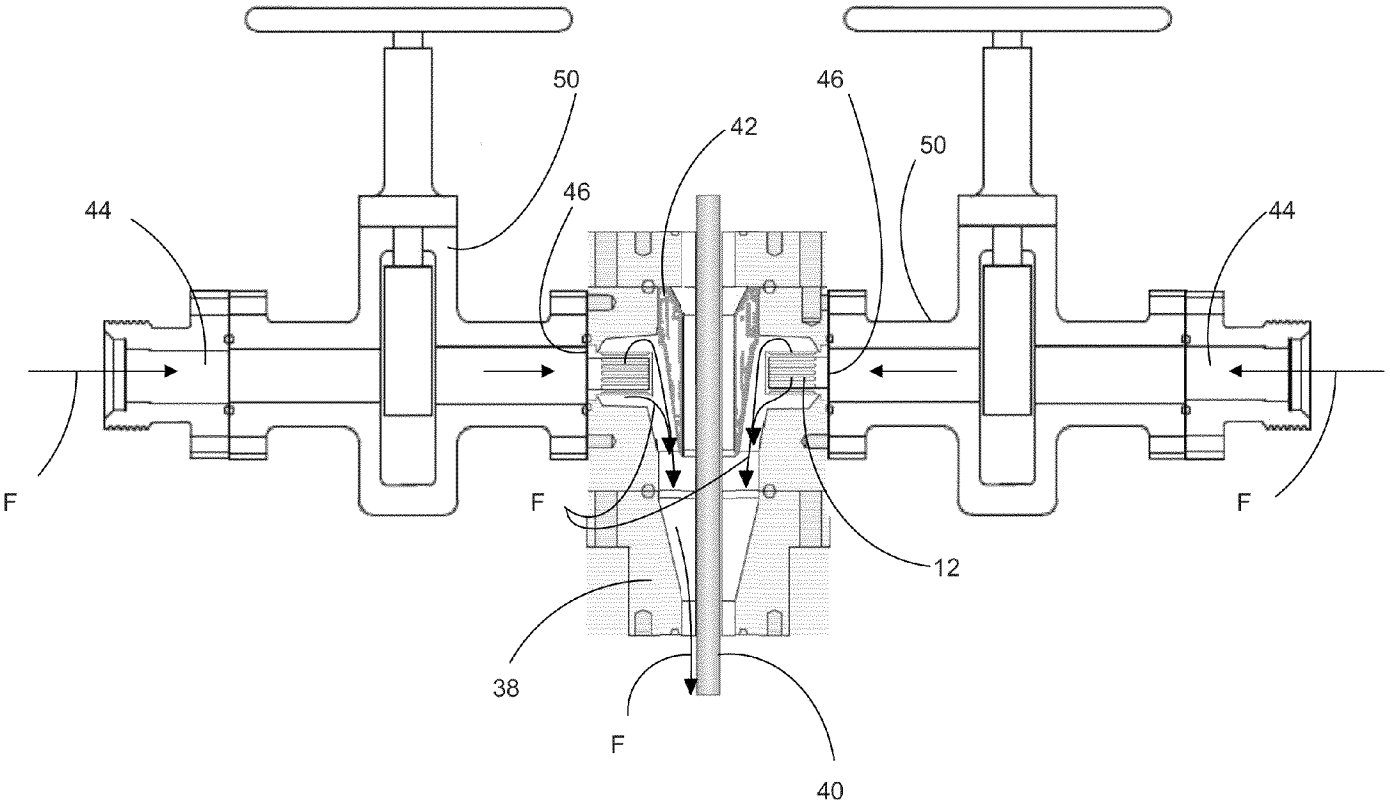
FIG. 6A illustrates a cross-sectional view of the main block and connected isolation valves of the fracturing header of FIG. 5A.

In more detail, and as shown in FIG. 6A, the main block 38 is coupled at inlet ports 46*a*,4*a* to isolation valves 50,50. Coil tubing 38 passes through a deflector sleeve 42 fit to a main bore 52 in the block 38. The inlet ports 46,46 are arranged in the block 38 opposing one another and fluidly connected with the main bore 52. Each inlet port 46 forms a trajectory of fluid F which is generally towards a centerline of the main bore 52, through which the coil tubing 38 passes. In this instance the coil tubing 38 is primarily protected from fracturing fluid by the deflector sleeve 42, intercepting fluid before impinging upon the coil tubing 38. The screen inserts 12,12 further deflect the incoming fluid.

Figure 6B:
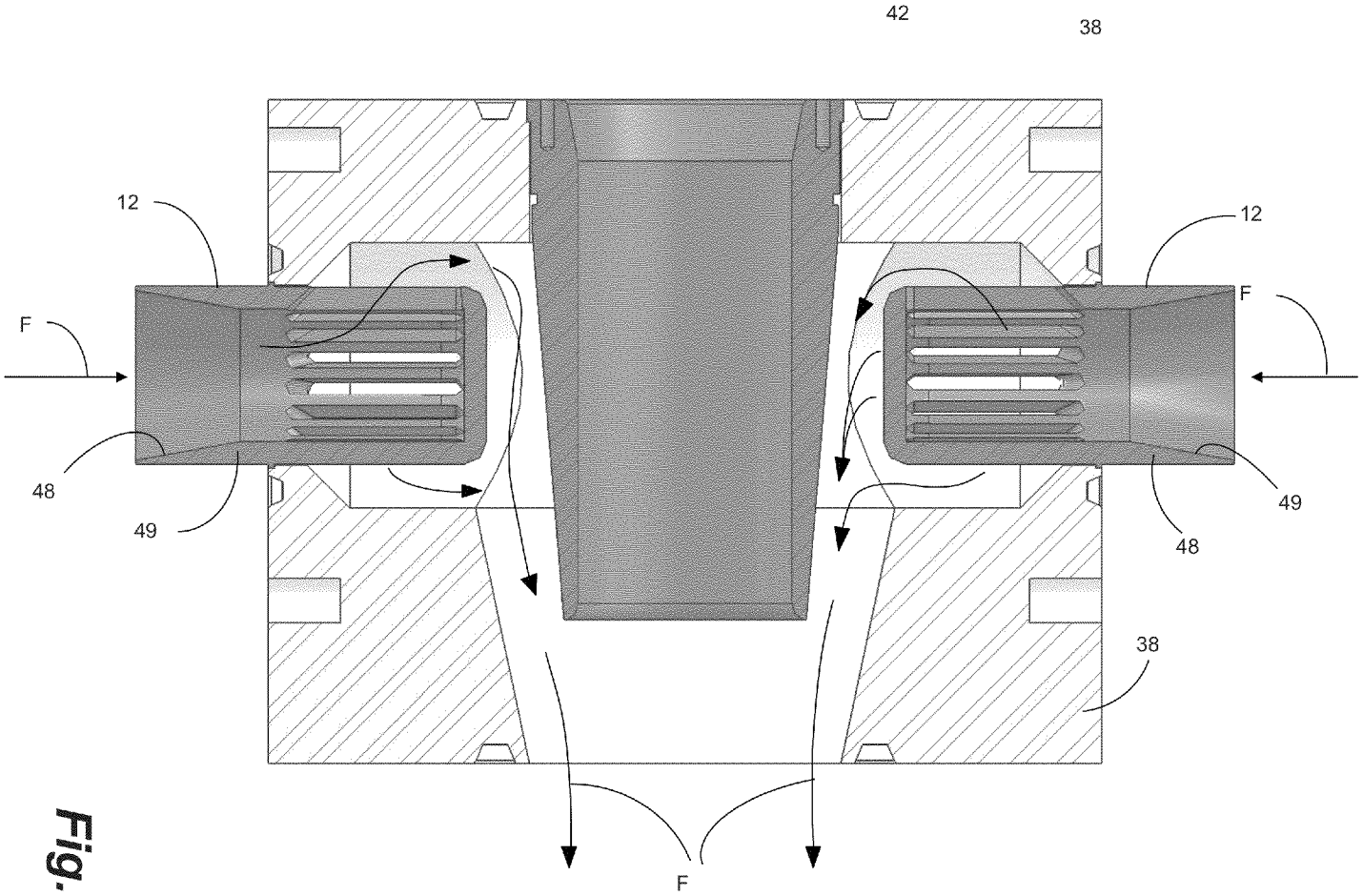
FIG. 6B illustrates a close-up of the main block of FIG. 6A and in particular a form of interface between the block and insert for sealingly sandwiching the insert between the block and a flange of connecting piping (not shown)

Better shown in the embodiment illustrated in FIG. 6B, fluid F flows radially from the inserts 12,12, about the deflector sleeve 42, and down the main bore 52 to the wellbore, generally parallel to the coil tubing 38.

Often the connecting interfaces, such as block valves 50,50, have bore diameters which are larger than that of the fracturing block 38. In such cases, there is a vulnerability of the inlet ports 46 and valve interface to flow disruption and elevated erosion. With reference to FIGS. 6B abs 7A, the insert 12 can be fit with a sleeve extension 48 for extending into the bore of the fluid inlet connecting conduit such as a valve 50. The sleeve extension 48 forms a tapered inlet 49 for a more orderly fluid flow from the generally larger bore of the valve to the smaller bore of the inlet port 46. The upstream inlet end of the insert has an inlet size substantially that of the connecting conduit Therefore, the screen bore 24 is tapered intermediate the larger diameter upstream inlet end and the smaller diameter adjacent the openings.

Figure 7B:
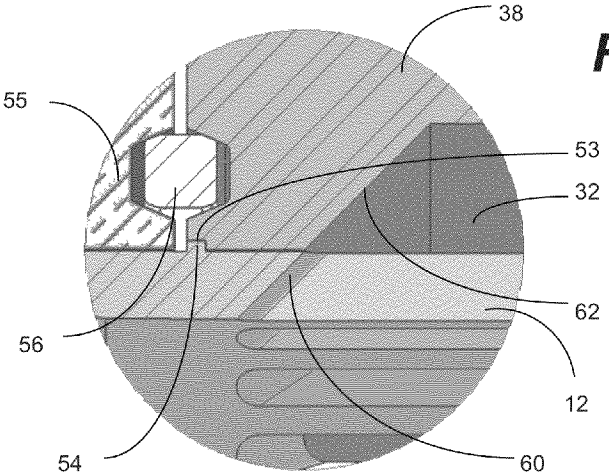
FIG. 7B illustrates a close-up of an interface between the block, isolation valve flange and insert sealingly sandwiched therebetween.
Figure 7A:
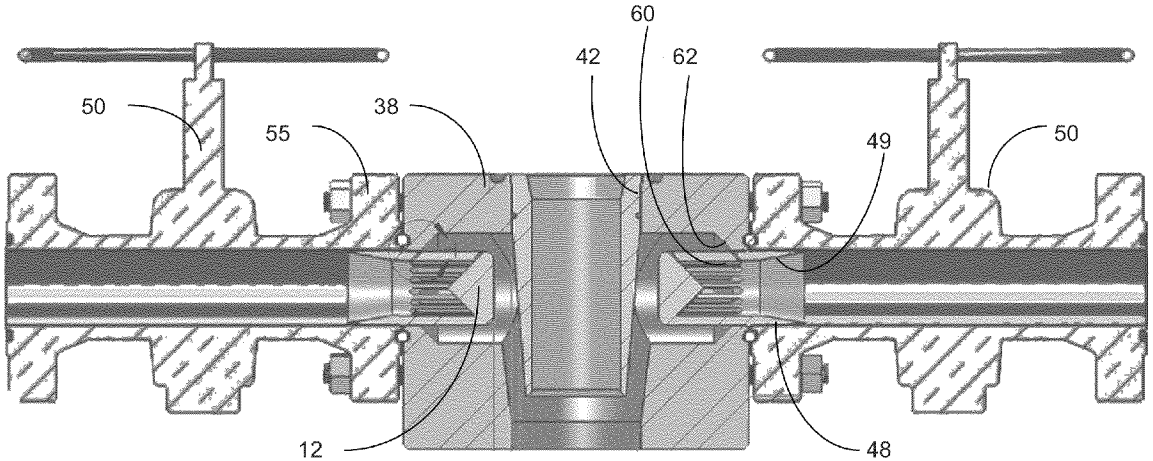
FIG. 7A illustrates another cross-sectional view of a main block and connected isolation valves.

In another embodiment illustrated in FIG. 7A, the flow of fluid exiting the inserts is manipulated and the insert itself is fit with a circumferential flange, intermediate along its length, for mounting in the block. As shown, the downstream endwall of the inserts 12 are shaped, in this instance conical, with the apex projecting upstream, directing a generally axial flow through the sleeve bore 24 to an angularly outward flow into the annular flow area 32. The conical endwall directs the flow F generally radially as before, but with improved flow dynamics and reduced wear on the insert. However, the flow dynamics in the main bore 52 may be less favorable for impingement on the coil tubing. Further empirical response will ascertain the various combinations of insert and main bore flow dynamics.

As shown in more detail in the close up of FIG. 7B, the inlet ports 46 of the main block 38 are fit with an annular inlet recess 53 and the insert 12 includes a circumferential flange 54 sized to correspond with the annular inlet recess 53. The insert 12 is retained in the block 38 and flow F to avoid being lost downhole. Basically, the insert 12 is provided with an upset or flange 54 intermediate its length for fitting with a corresponding annular recess 53 formed in the block at the interface with an upstream isolation valve 50 or other intermediate connectors, spool or piping. The insert 12 is inserted into the inlet port 46 until the flange 54 seats in the recess 53. The valve 50 is connected to the block 38, sandwiching the screen inset 12 securely to the block 38.

The valve 50 is fit with a flange 55 for connecting to the main block. The insert's flange 54 fits to the block's annular inlet recess 53 and the valve flange 55 sandwiches the circumferential flange to the main block, the screen insert being retained therein and the sleeve extension extending onto the valve 50. As is typical, the valve flange 55 is sealed to the main block using a ring seal 56.

Figure 8B:
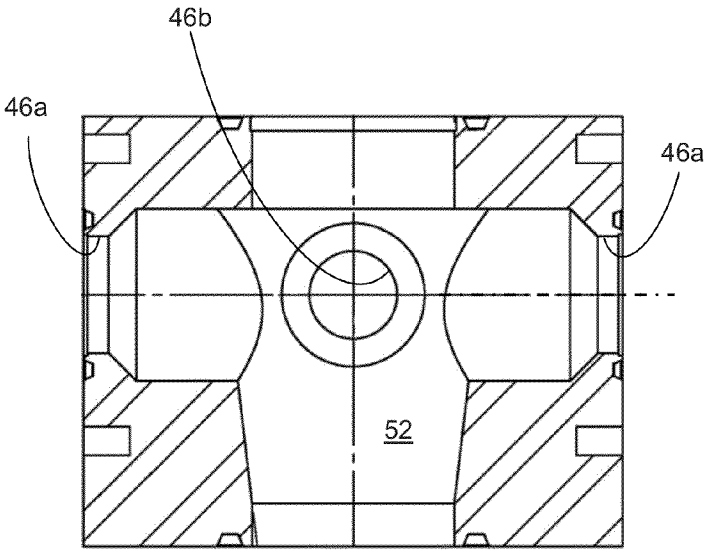
FIG. 8B is a side, cross-sectional view of the main block cut through the larger inlets along the larger opposing inlets.
Figure 8A:
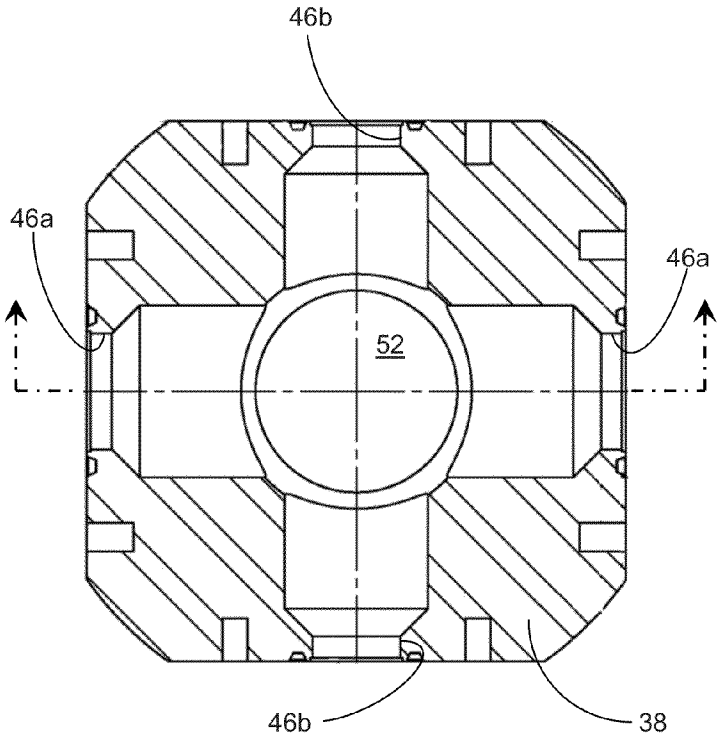
FIG. 8A is a top, cross-sectional view of the main block cut through the centreline of the four inlets.

Turning to FIGS. 8A and 8B, the main block 38 can be fit with two or four inlet ports 46. The inlet ports 46 are typically arranged in opposing pairs, such as that shown in FIG. 4B, a first pair 46*a*,46*a* and 46*b*,46*b*. While all ports can be of the same diameter and flow capacity (See FIG. 11), the ports 46 can be of different sizes—generally having pairs of opposing ports having the same sizes for balancing inlet flow dynamics. As shown in the plan view of FIG. 8A, a first pair of opposing ports 46*a*,46*a* can be larger than a second pair of ports 46*b*, 46*b*. In FIG. 8B, sectioned through the larger inlet ports 46*a*,46*a*, one inlet port 46*b* of the smaller, second pair of ports 46*b*,46*b* is shown in the background.

Note that the overall height of the block 38 is maintained as consistent as possible for ready substitution in a fracturing header without dimensional changes. For example, a block having 4 1/16" diameter first ports 46*a*,46*a* would have an overall height equivalent to that for a block having 3 1/16" first ports 46*a*,46*a*. As shown, a block 38 can be fit with both 4 1/16" and 3 1/16" ports.

Figure 9A:
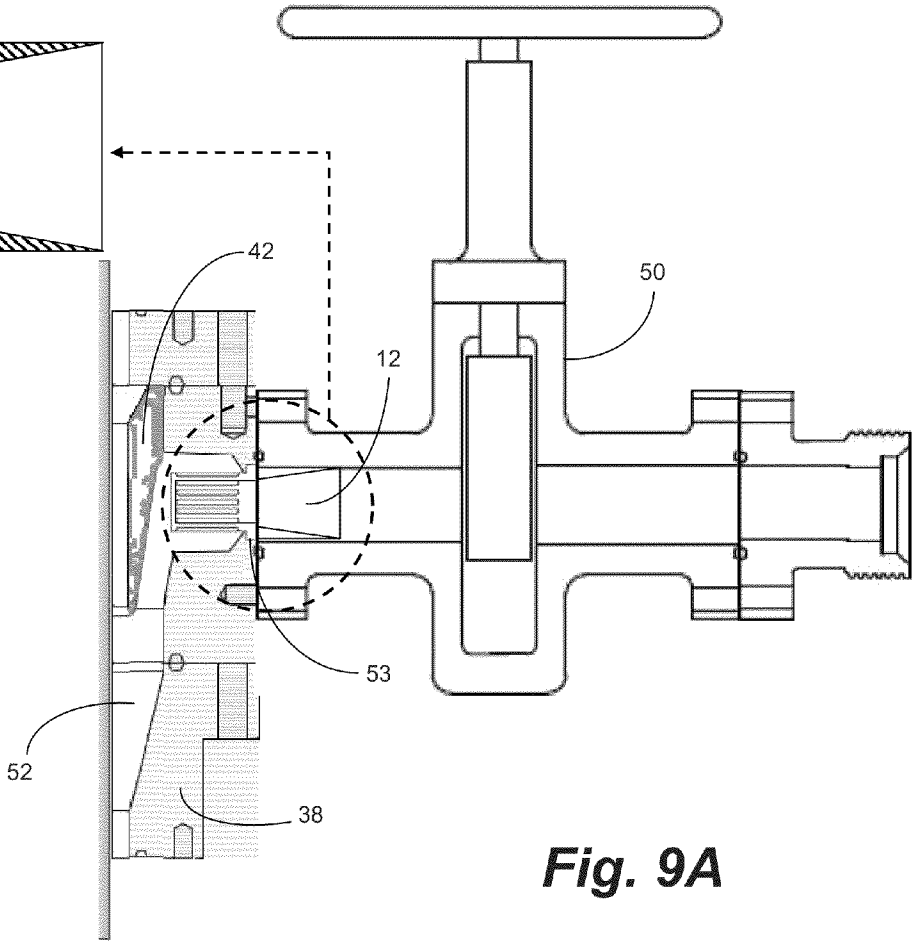
FIG. 9A is a partial, cross-sectional view of one inlet port of the fracturing block of FIG. 6A for illustrating the insert installed therein
Figure 9B:
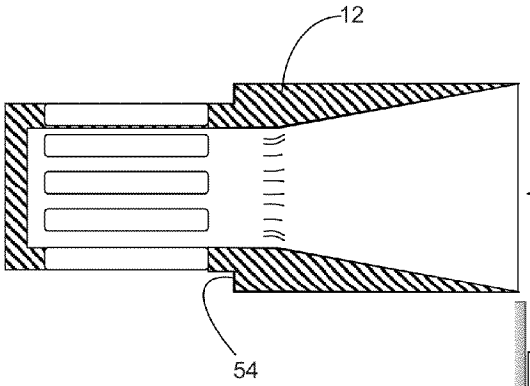
FIG. 9B is a cross-sectional view of one embodiment of the insert of FIG. 9A.

Referring to FIGS. 9A and 9B, another form of insert mounting is illustrated in which the connecting valve 50 is larger than that of the inlet port 46. The block 38 is also fit with an annular inlet recess and the insert 12 is also fit with circumferential flange, however the flange retains a full diameter and extends to an upstream end for fitting to the valve 50.

Figure 11:
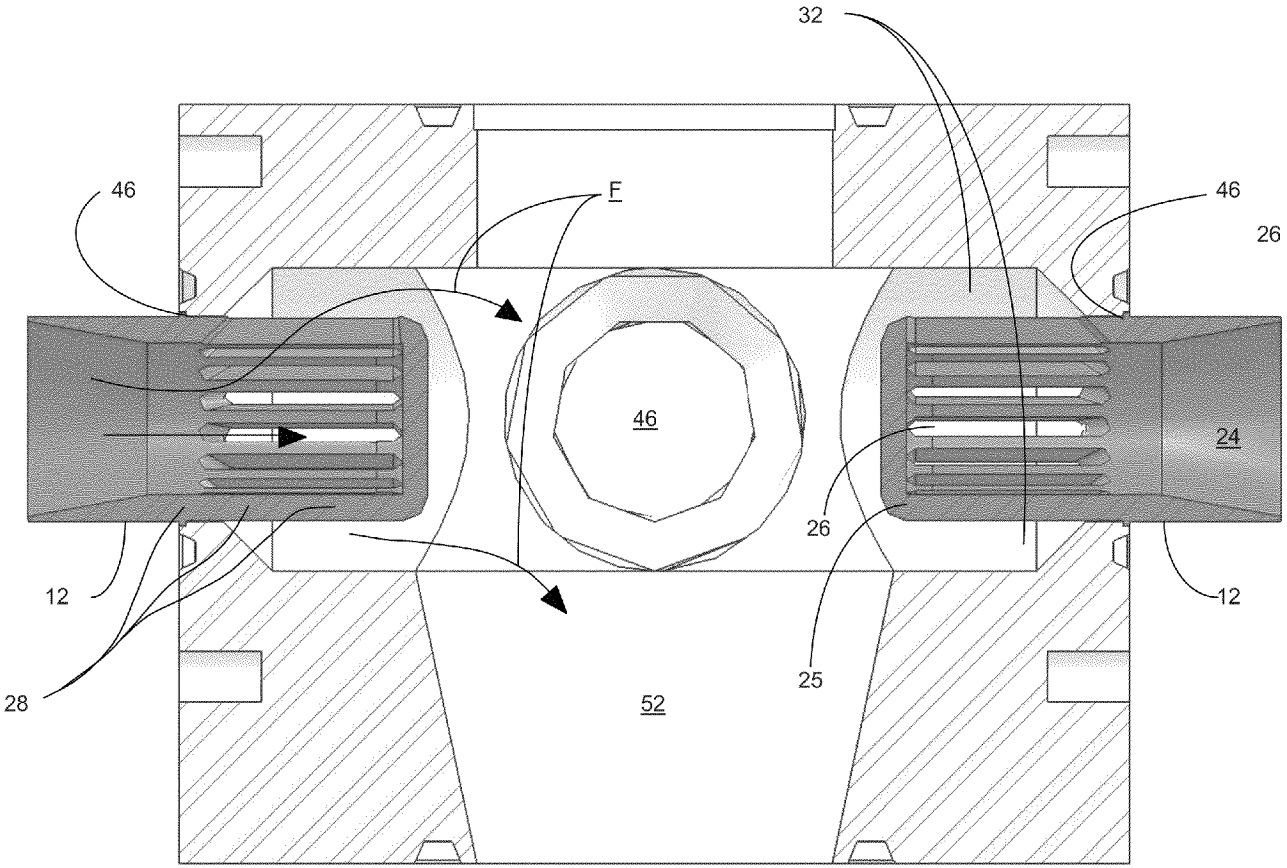
FIG. 11 illustrates a side cross-sectional view of a main block of FIG. 10A and opposing inlet ports fit with screen inserts, the open upstream end extending from the block for receipt into the connecting piping.
Figure 12A:
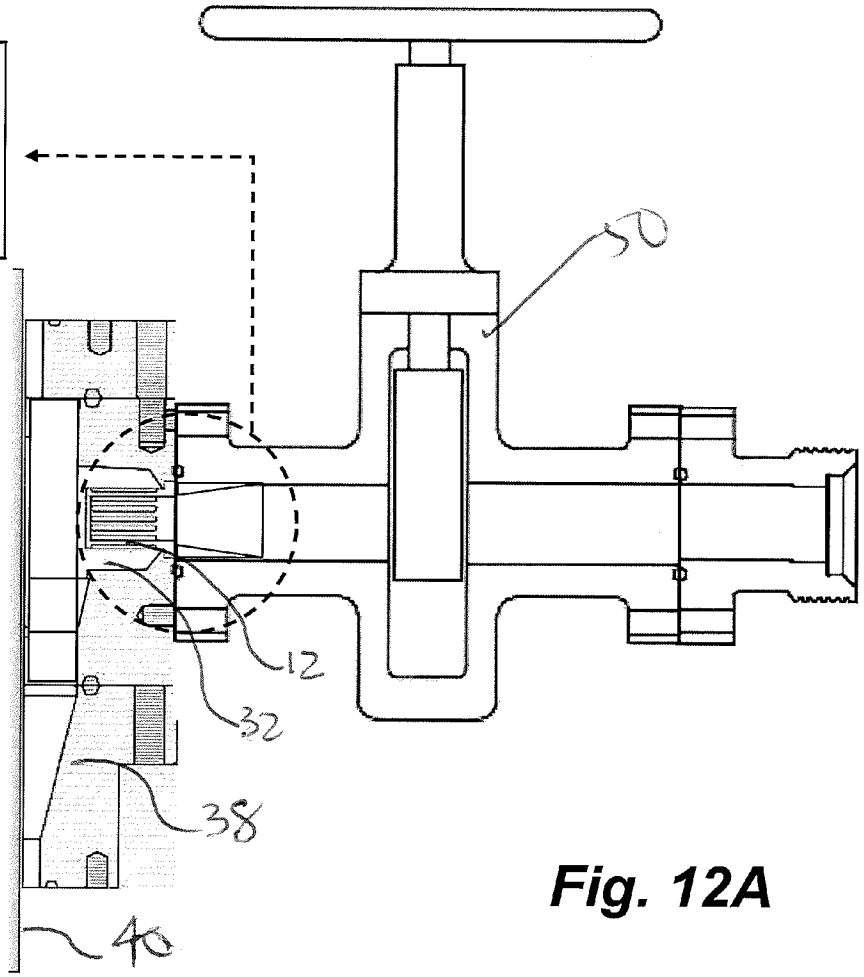
FIG. 12A is a partial, cross-sectional view of one inlet port of the fracturing block of FIG. 10A for illustrating the insert installed therein
Figure 12B:
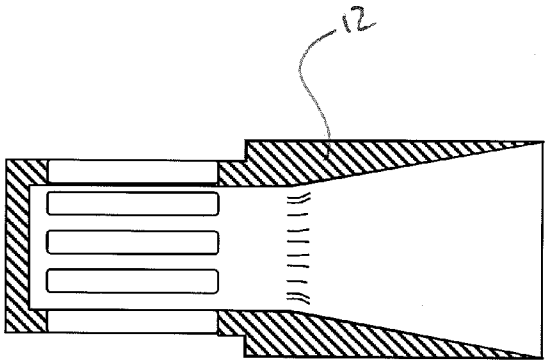
FIG. 12B is a cross-sectional view of one embodiment of the insert of FIG. 12A.

With reference to FIGS. 11 through 12B, the use of screen inserts 12 is equally applicable for use in a fracturing block 38 absent a deflection sleeve.

Figure 10B:
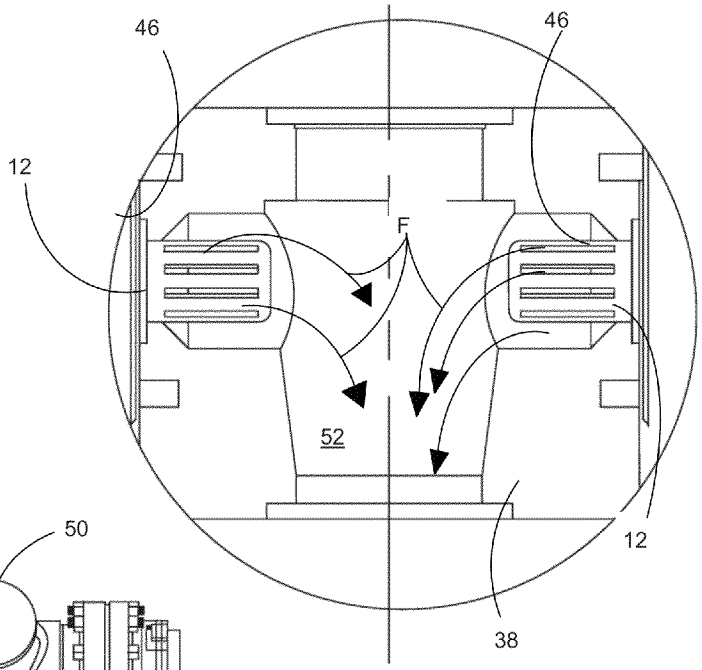
FIG. 10B is an enlarged view of the circled area of the main bore showing the main bore sleeve and the two inserts.
Figure 10A:
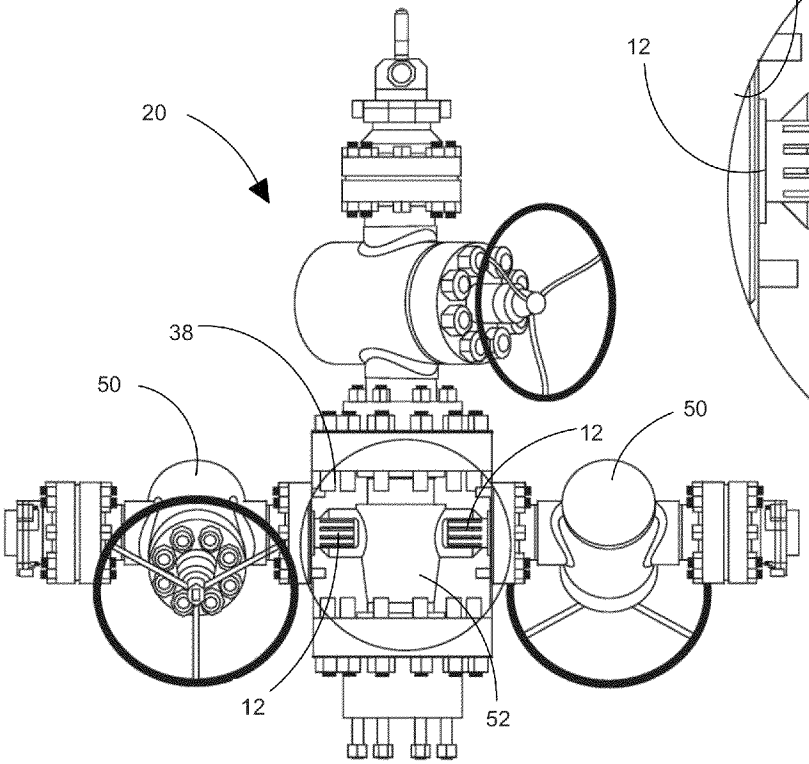
FIG. 10A illustrates a side view of a fracturing header with a main block shown in cross-sectional view, the main block fit with two opposing inlet ports and isolation valves fit to each port, the main bore absent a deflecting sleeve.

Turning to FIGS. 10A, 10B, and FIG. 11 the inlets 46 of the block 38 are enlarged about the insert 12 to form annular flow areas 32 about each screen insert 12. Thus, firstly flow is permitted to exit the periphery of the insert 12 and secondly, one can optionally reduce the velocity of the flow as it transitions from the screen insert 12 to the main bore 52. Further, and as discussed below for the screen inserts themselves, the form of openings 26 can vary for a variety of objectives including manipulating flow velocity and wear behavior at the insert 12 or block 38. As shown, the screen bore 24 is closed or substantially closed or closed at a closed endwall 25 for forcing fracturing fluid through one or more openings 26,26 . . . . In the case of a basket screen for a fracturing header, the closed endwall is located at a downstream end. The openings 26 are formed along the tubular wall 28, and optionally also in the in the closed endwall (See FIG. 1). The openings 26 fluidly connect the insert bore 24 and the connecting piping including valves 50. The one or more openings 26 are circumferentially spaced about the tubular wall 28. The openings can be sized to maximize flow therethrough yet to capture pre-determined characteristics of known debris. The remaining portion of the tubular wall 28, between openings 26,26, remains sufficiently supported structurally.

As discussed, the annular flow area 32 is provided for receiving fluid flow and can further aid in velocity management. Again, the insert ports 46, the annular flow area and the insert are sized and configured to minimize the introduction of erosion markers. If there is structure or are tools present in the main bore 52, such as coil tubing or deflector sleeve or both, one can further minimize the tendency for erosion using inserts 12. As shown, with a deflector sleeve in place, the insert 12 or inserts 12,12 may or may not be fit with additional axial porting as was the case with the protruding screen insert for the more generic supply flow cases such as the equalization header. Axial porting discharges a flow stream generally directed at the centreline of the bore 52, such flow behavior being favorably dissipated against an opposing and incoming flow of fluid, but less desirable if directed at an obstructing component. However, in such embodiments a blank or closed endwall deflects fluid from such components, particularly if there is no deflector sleeve in place.

For example, a typical fracturing header, having coil tubing extending through a 4" main bore downhole may only have an 8 to 9 square inch annular flow area about the coil tubing. Typically fracturing fluid is provided through 2.25" diameter supply piping, each having a cross section of 4 sq in for two inlets being 8 sq ins or about equal to the net area about the coil tubing. Entering the fracturing block having a 4" diameter fracturing head inlet port, the inlet area of each of two or more inlets is about 12.5 square inches, however the screen inlet only has a 3" internal diameter or about 7 square inches each and thus for two inlets the useable area is 14 square inches, about half that being supplied, but necessarily doubling by the time it flows down the fracturing header to about the coil tubing. About the screen insert, the annular flow area at a 6" diameter is 28 square inches for a net annular flow area of about 15.5 sq in, maintaining a lower velocity as the flow traverses the change in direction from the opposing inlet ports 46 to the main bore 52. Accordingly the fluid flow velocity is reduced as it flows from each inlet as it enters the fracturing header bore about the coil tubing of deflector sleeve. Thus the fluids velocity is at its lowest as it turns to commence its downhole run to the tools down below.

Turning to FIGS. 13A through 18B, the inserts 12 themselves are described in more detail.

Figure 13B:
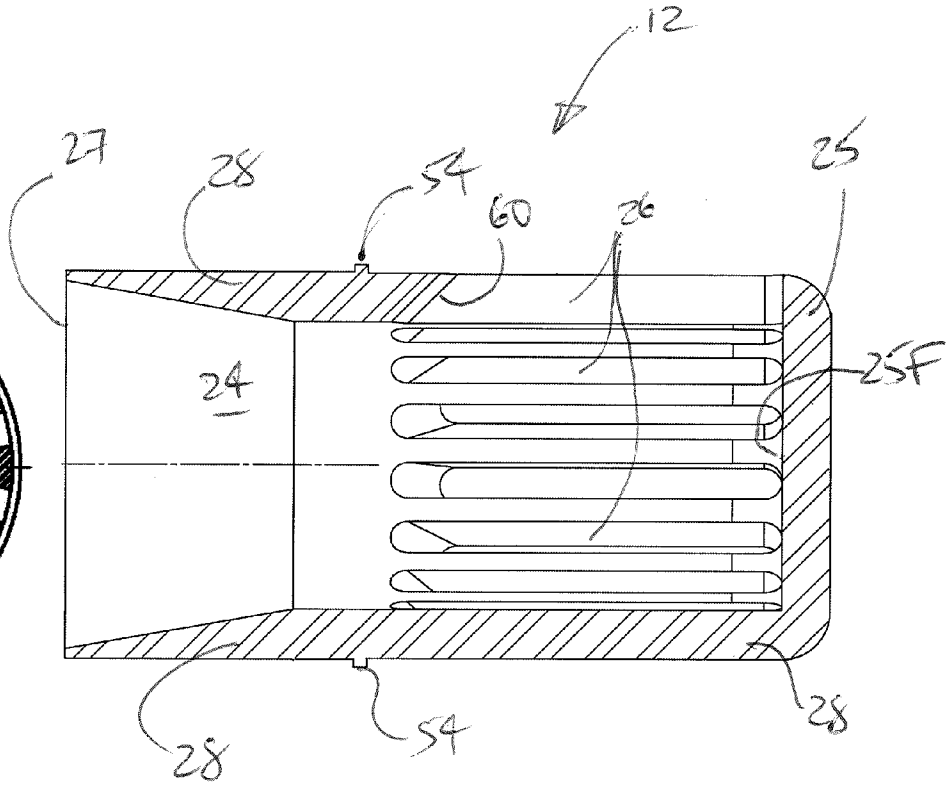
FIG. 13B is a side, cross-sectional view along line 13B-13B through a screen opening and through the wall.
Figure 13A:
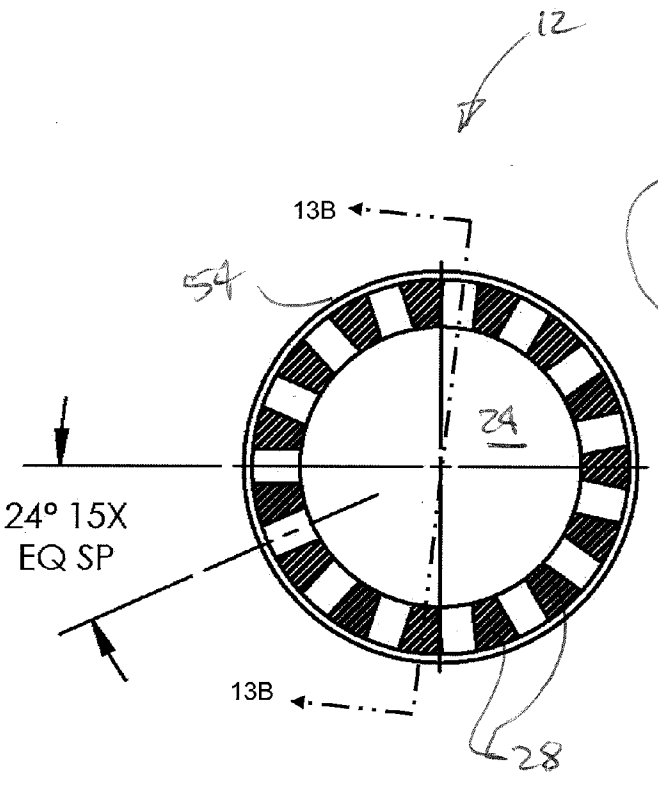
FIG. 13A is a cross-sectional view of a flat-end screen insert, sectioned through the screen portion.

With reference to FIGS. 13A and 13B, a tubular insert 12 is shown having closed endwall 25 and open end 27. In this embodiment, the open end in an open inlet. One form of manufacture includes taking a tubular section and adding a closed endwall, such as a circular plate secured at an end of the tubular section for forming the structure of the insert. The screen insert is then machined in a computer numerical control (CNC) unit for dimensional sizing and tapers and then slotted in a milling machine such as by using a slot drill. The tubular material can start as a high tensile strength alloy which is also treated such as by spraying with a tungsten or similar hardened material to resist erosion. The screens can be manufactured of wear resistant materials, such as EN30B, a nickel air/oil hardened steel having high strength and toughness, or other materials with a wear coating, surfacing or both.

As shown, a nominal 4 1/16" diameter would have an internal diameter of bore 24 of about 3". A plurality of slots-like openings 26 are formed through the tubular wall 28 each of having a length of 4"×0.375" in width. Fifteen openings 26 can be formed for a total of 22.5 sq in. A different number and size of slots could be used. A nominal 3 1/16" diameter screen insert 12, can have a 2 1/16" bore 24 and the tubular wall 28 being fit with 4" long×0.375" slot-like openings 26. Ten openings provide about 15 sq in of flow area. The circumferential flange 54 can be in the order of about 1/16-3/32".

Figure 17A:
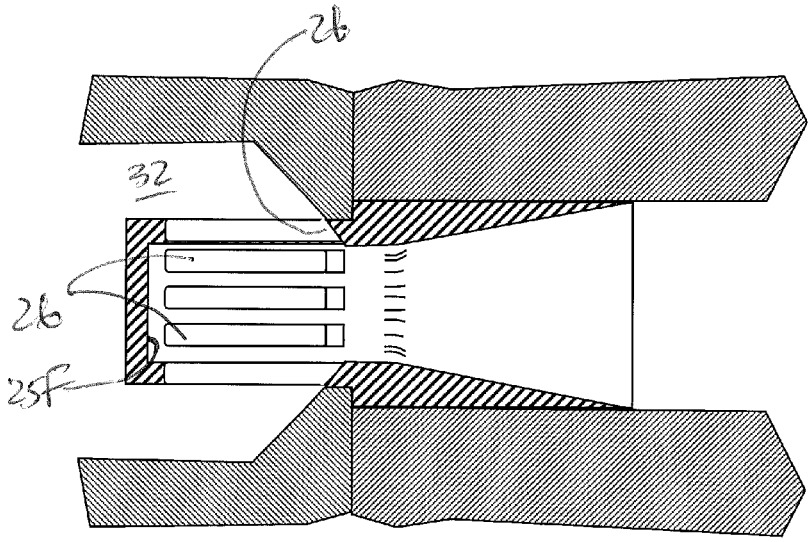
FIG. 17A illustrates a main block inlet port having an enlarged annular area about the screen for receiving flow of fracturing fluid, the screen having profiled openings corresponding to a transition in the inlet port to the annular area.
Figure 17B:
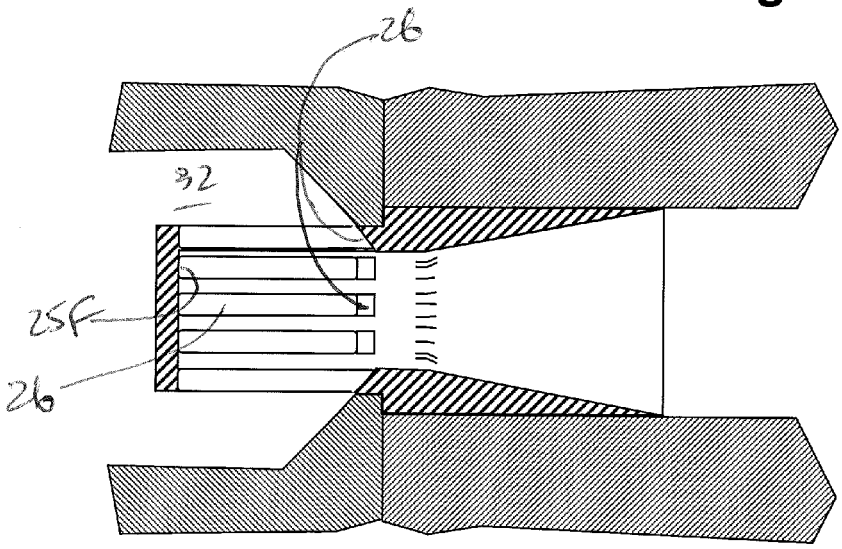
FIG. 17B illustrates the arrangement of FIG. 17A wherein the sleeve insert opening extend to the downstream end wall.

Further, as shown, the openings 26 can be profiled on an angle to generally correspond with a fluid flow path from the insert bore 24 to the annular flow areas 32 when in use within the fracturing block 38. An angle of 45 degrees is shown. The openings in the tubular wall 28 from the insert's interior or bore 24, to the insert's exterior or annular flow area 32 can be square cut or profiled to minimize flow disruption. An example of profiling in the openings includes angled opening ends 60 shown in FIGS. 13B and 14B. Having reference to FIGS. 7A and 7B as the flow of fluid exits the openings 26, angled ends 60 can also be aligned with an angled inlet end 62 of the annular flow area 32, avoiding eddies and erosive flow disruptions. Further, FIG. 17A illustrates the profiled openings corresponding to a transition in the inlet port to the annular flow area 32. Further, in FIG. 17B the openings are extended downstream to the closed endwall. In FIG. 17A, the openings 26 include upstanding square cut slot ends at a downstream end of the insert 12 or flush cut slot ends as shown in FIG. 17B. Other profiles can be configured if one wishes to control the egress of fluids and corresponding effects or impact on components extending through the main bore 52.

Figures 14A, 14B:
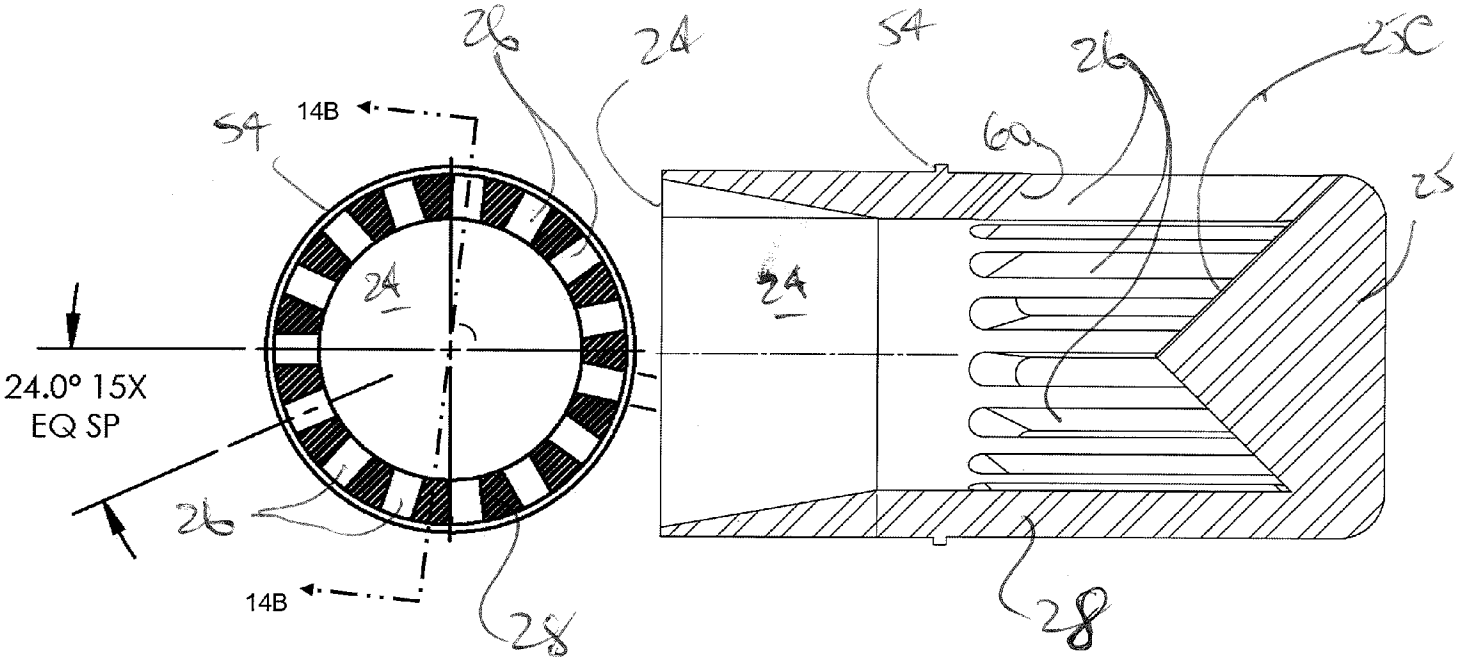
FIG. 14A is a cross-sectional view of a conical-end screen insert, sectioned through the screen portion.
FIG. 14B is a side, cross-sectional view along line 14B-14B through a screen opening and through the wall.

Comparing the inserts of FIG. 13B, a flat end wall 25F, and FIG. 14B, a conical end wall 25C, one can see two embodiment or variations in the style of the closed endwall 25. As shown in FIG. 14B, the conical end wall 25C also directs fluid outwardly through the openings 26. A flat end wall 25F of FIG. 13B could further diffuse the energy of the fluid flow prior to passing through the slot-like openings into the annular flow areas 32 and then onward toward the main bore 52.

The openings 26 are spaced circumferentially and each is sized to maximize flow therethrough yet trap debris within. The openings can be equally spaced, more so dictated by manufacturing convenience.

Figures 15A, 15B:
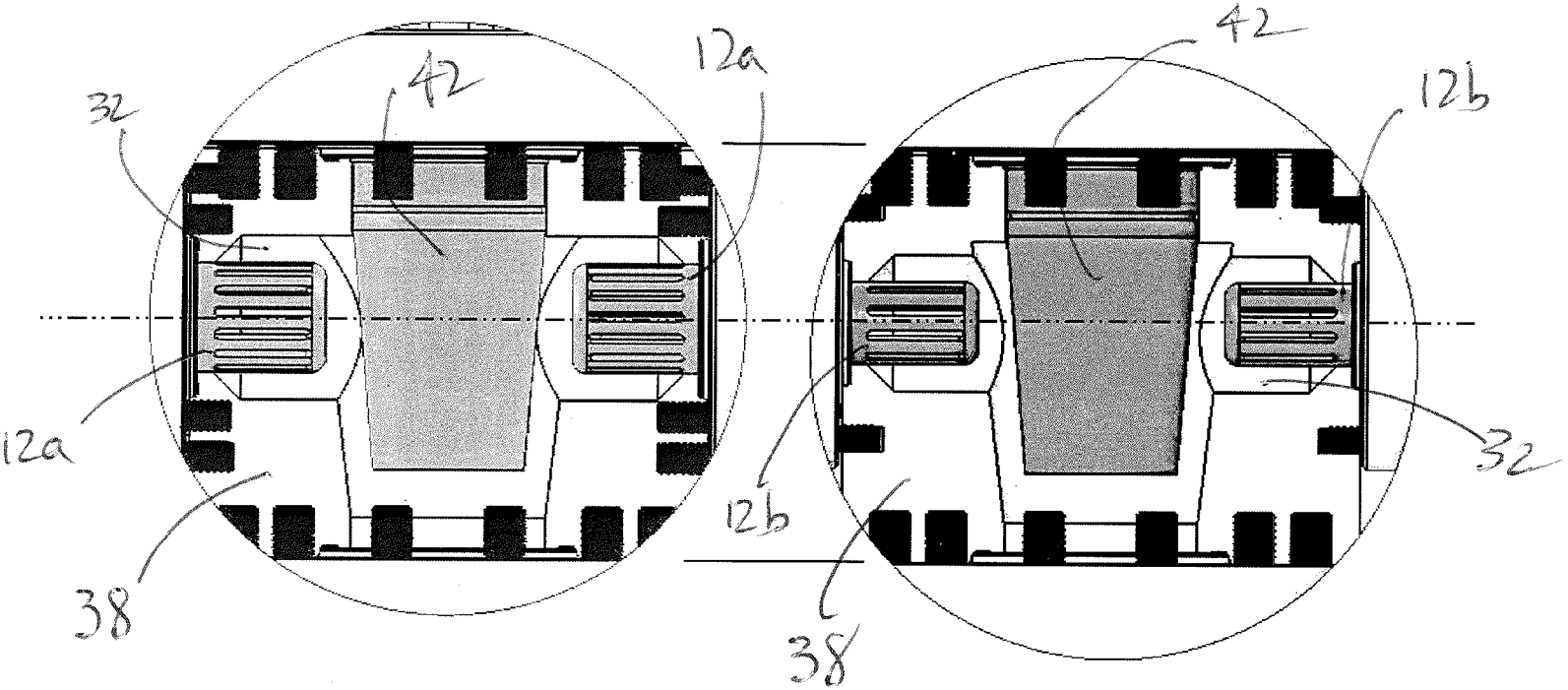
FIGS. 15A and 15B are side by side comparisons of two main block having same mounting dimensions but fit with nominal 4 inch and nominal 3 inch screen inserts respectively.

Turning to FIGS. 15A and 15B, a fracturing block 38 is shown in two different embodiments here being a 15 inch high, 18.9 inch square block fit with nominal 4 1/16" inserts 12*a*,12*a* (FIG. 15A) and 3 1/16" inserts 12*b*,12*b* (FIG. 15B). The main bore 52 has a 7" diameter at top and bottom with an internal taper resulting in a localized diametral increase at about the inlet ports 46.

The inlet ports 46 as sized to accept the outer diameter of the screen inserts. Each inlet port 46 is enlarged within the block 38 for form the annular flow areas 32 which are contiguous with the main bore 52. In the case of the 4 1/16" insert, the annular flow area 32 can be about 6" in diameter for about a 1" annular flow area about the insert. In the case of the 3 1/16" insert, the annular flow area 32 can be about 5" in diameter, also for about a 1" annular flow area about the insert.

The insert extends inwardly from the inlet port 46 sufficiently so that the openings 26 discharge into the annular flow area 32. The mounting of the insert is also coordinated so that the closed endwall 25 terminates before the through bore portion of the main bore 52. For example, for a block 18.9" across, about 9.45" to the centerline, the circumferential flange of the insert can be set back about 4.8" so as to terminate at about 4.65" from the centreline. This leaves a clear through bore of 9.3". In this case the main bore for passage of tools therethrough is about 7", providing more than enough clearance to avoid tool or interference of a deflector sleeve 42 with the inserts 12. In an embodiment, the flow exiting the insert's openings 26 can be at a velocity less than about that of the supply of fracturing fluid to the fracturing header 20.

With reference to FIGS. 16A, 16B and FIGS. 18A and 18B, various alternate methods for securing the inserts 12 in the inlet ports 46 are shown.

Figure 16A:
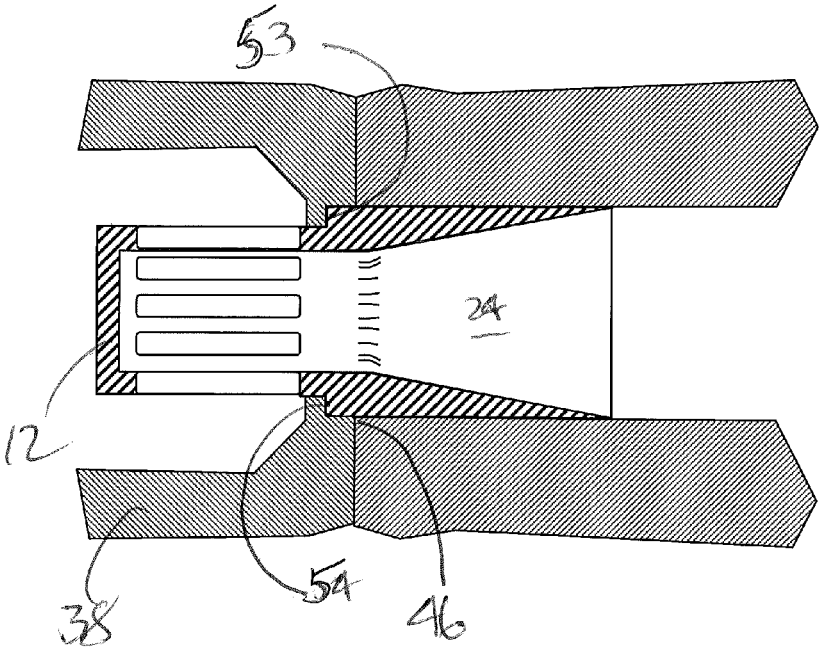
Figure 16B:
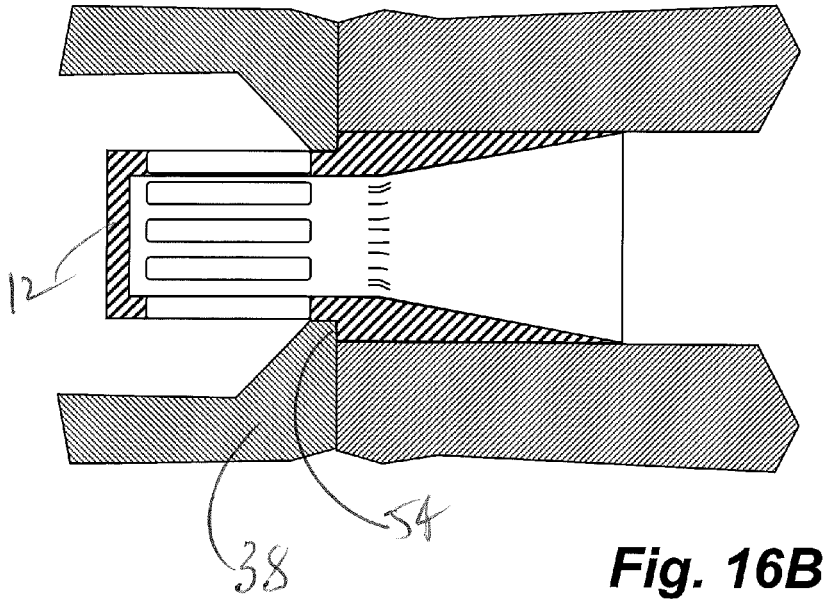
FIG. 16B illustrates a main block inlet port having a smaller diameter than that connecting piping forming an annular seat against which a shoulder on the insert bears.
Figure 18A:
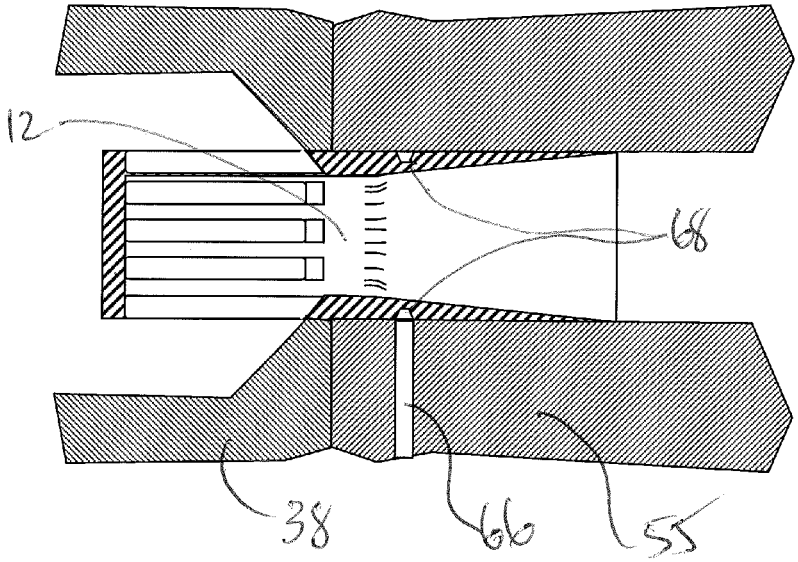
FIG. 18A illustrates a main block inlet port without a seat and the use of a radially extending set screw form of retainer.
Figure 18B:
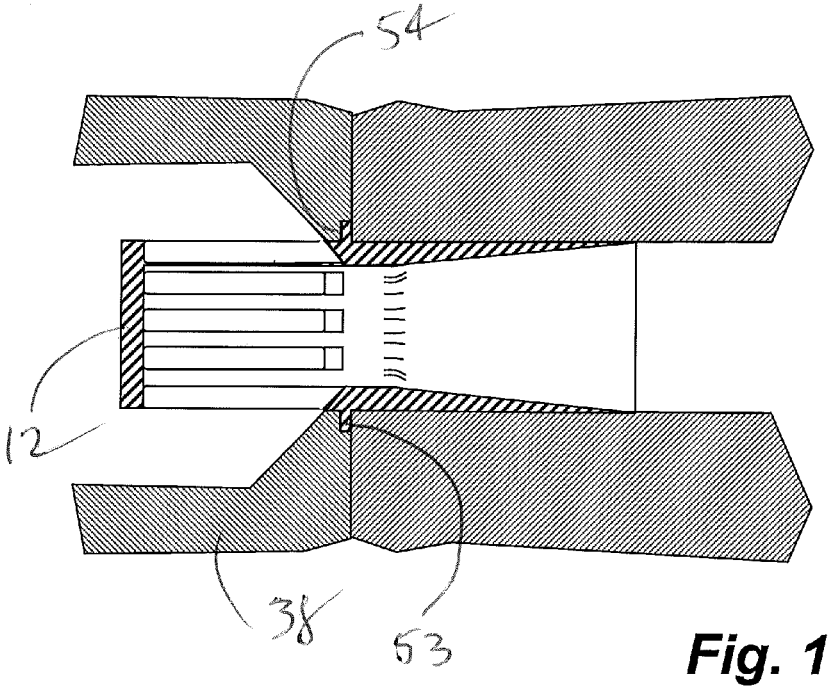

In FIG. 16A, the insert is secured in a main block inlet port 46 having an annular recess 53 in the block 38 about the inlet port 46 forming a seat against which a shoulder of flange 54 of the insert rests or bears. In FIG. 16B the block is not provided with a recess 53 so the insert flange 54 bears directly on the block itself at the inlet port 46. In FIG. 18A illustrates a main block inlet port 46 without a recess and an insert 12 without a flange. The insert is secured against movement using a retainer 66 such as a radially extending set screw. The insert is fit with one or more pockets or a circumferential groove 68 for receiving the retainer 66. The retainer can be arranged in the block 38, or as shown through the connecting piping or flange 55. FIG. 18B illustrates the insert 12 according to FIGS. 7A,7B and FIGS. 13B and 14Ba having a flange 54 for engagement with an annular inlet recess 53.

EXAMPLE

Screen Inserts

A wellbore fracturing operation was conducted. As the tool used was large in diameter, no deflector sleeve was used in the fracturing header. The operation was conducted at 3 $M^3$/min of fracturing fluid from each of four inlet ports for a total of 12 $M^3$/min combined flow. The fracturing header was fit with four 4 1/16" screen inlets. A total of about 300 tonnes of proppent was delivered downhole. Upon inspection, the coil tubing was in superb condition and the screen inserts showed only slight erosion. Note that a 4 1/16" diameter screen is rated at about a max rate of 3 $M^3$/min of fracturing fluid and a 3 1/16" diameter screen is rated at about a max rate of 2 $M^3$/min.

Relative velocities were as follows. Each 2.25" supply conduit, at 3 $M^3$/min was flowing at about 64 ft/sec and once the flow exited the screen insert into the 6" diameter annular flow area about the 4" screen insert (net annular area of about 15.7 sq in), the velocity has slowed to about 16 ft/sec before the coil tubing was exposed to the flow of fluid and proppent.

In one aspect, the screen inserts are provided to contain debris but another aspect includes the ability of the design and use thereof to diffuse and deflect the sand and proppent-laden fluid prior to contacting the susceptible coil tubing. Further, use of the screen intakes allows the operator to eliminate the use of the main deflector sleeve, enabling the running of larger downhole tools.

As found, it is desirable to avoid the need for a main deflector sleeve as the resulting main bore is left wide open, avoiding restrictions and hang-ups when passing large diameter downhole tools. Optionally, a screen insert can also be provided below the deflector sleeve, at the bottom of the fracturing header, sized with an opening to pass the coiled tubing.

Flowback System

Following fracturing, fluids are returned to the surface, such returns known as flowback. Flowback is comprised of a portion of the fluid and contained debris, sand and proppent used to fracture the wellbore. The flowback material is also a management and erosive wear challenge. Further, it is conventional in the prior art to provide a separate flow block for redirection of returning fluids. This extra block is firstly another component at additional expense, and also further increases the height of the fracturing header by both the height of the block and that of a connecting spool (See FIG. 3A).

Herein, for fracturing operations conducted at lower rates that do not require the maximum capacity of a fracturing block, one of the former inlets can be configured as a flowback port. For example, a four inlet block, fit with 4" inlet ports, normally capable of flows of 12 $M^3$/min could be used for a fracturing job programmed for a maximum rate of 6 $M^3$/min. Accordingly, only two inlet ports are used for fracturing operations and one port is used for flowback. The fourth port is blocked off.

Figure 19:
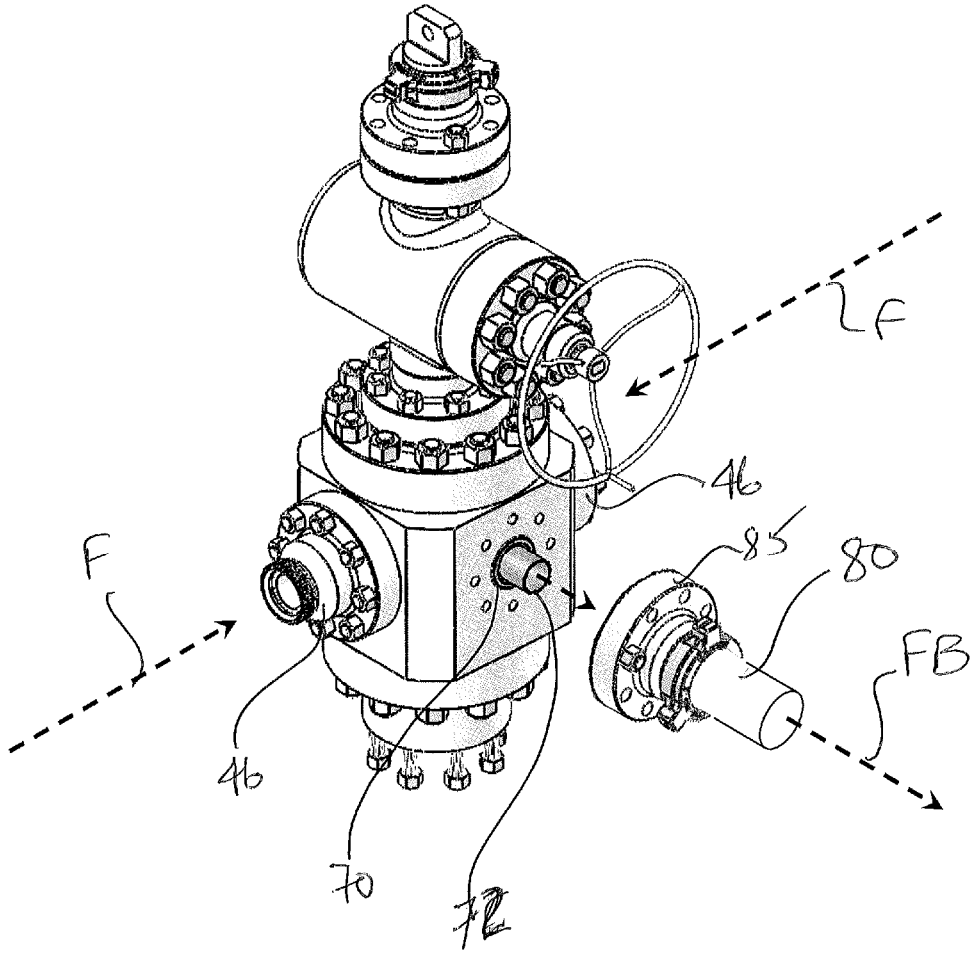
FIG. 19 illustrates a combination fracturing and flowback header, with arrows indicating opposing inlets for inflow of fluid during fracturing and outflow of fluid during flowback.

With reference to FIG. 19, a fracturing block 38 can be adapted for both fracturing and post-fracturing flowback operations. Such a multipurpose block 38M is equipped with a pair of opposing inlet ports 46,46 for fracturing. A third port is configured as an outlet port 70 for the discharge flow of flowback FB. A forth port, not shown, and if available is blocked. The outlet port 70 is also fit with a flowback sleeve insert 72. The flowback sleeve insert 72 is provided as a wear sleeve for protecting the vulnerable interfaces between block 38M and connecting piping or valving against the abrasive flowback FB. As with the screen inserts above, the tubular sleeve material can start as a high tensile strength alloy which is also treated such as by spraying with a tungsten or similar hardened material to resist erosion, manufactured of wear resistant materials, such as EN30B, or other materials with a wear coating or surfacing or both.

As discussed above, the erosive effect of the flow of fracturing fluids on downhole tools is effectively managed using either a deflector sleeve 42, screen inserts 12,12 or both a deflector sleeve and screen inserts. FIG. 19 illustrates an embodiment using a deflector screen 42, however the inlet ports 46,46 could also be fit with screen inserts (not shown).

Connecting discharge piping 80 and connections such as a valve 80V (FIG. 20A) or piping 80P (FIG. 21A) connects to the outlet port 70 for receiving the flowback FB.

Figures 20A, 20B:
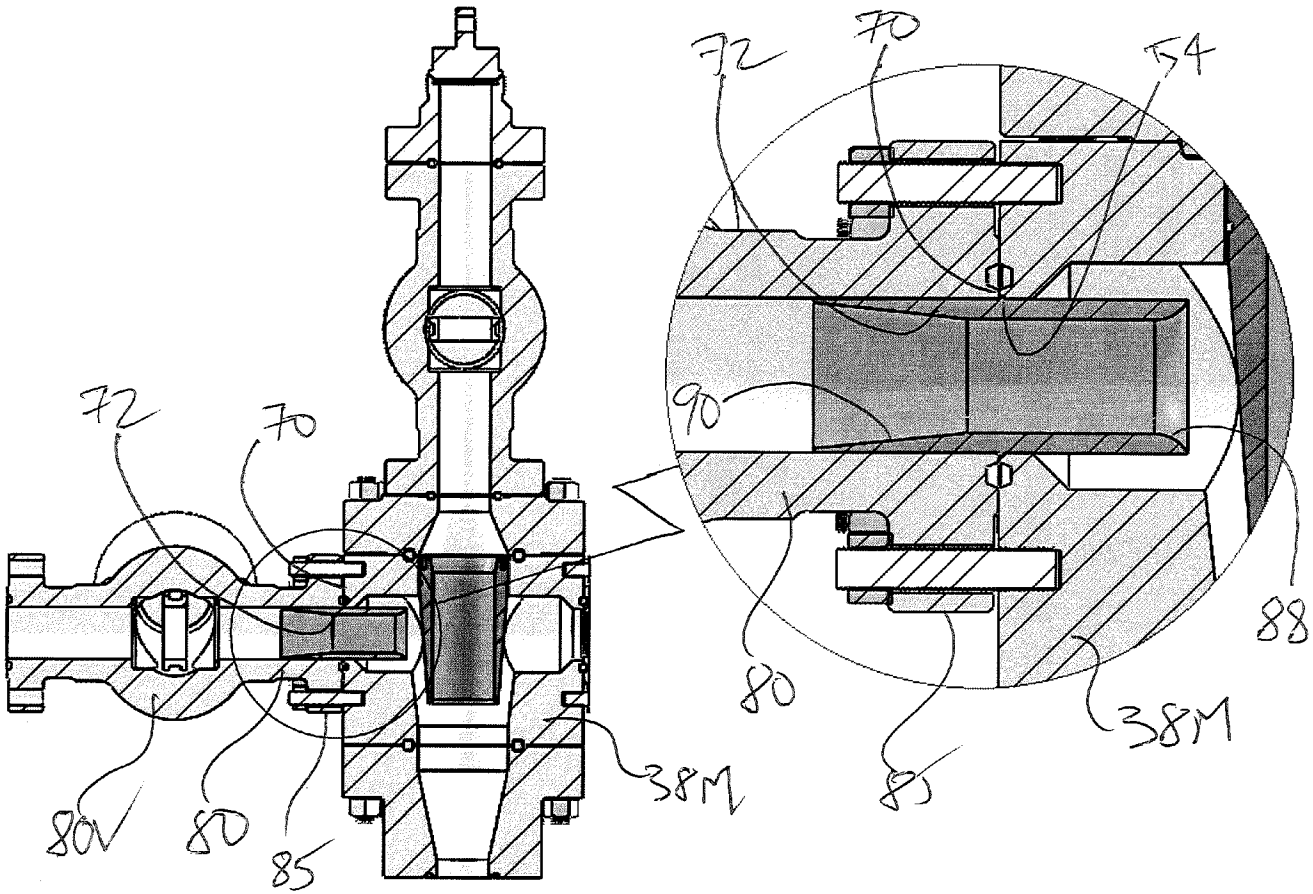
FIG. 20A is a cross-section of a fracturing-flowback header, sectioned transverse to the inlet ports to illustrate the flowback outlet, outflow sleeve and an isolation valve, a blind flange on an opposing unused port not being shown.
FIG. 20B is a close-up of the outflow sleeve to the isolation valve of FIG. 20A, the piping having a like throughbore diameter to that of the outflow port.
Figure 22:
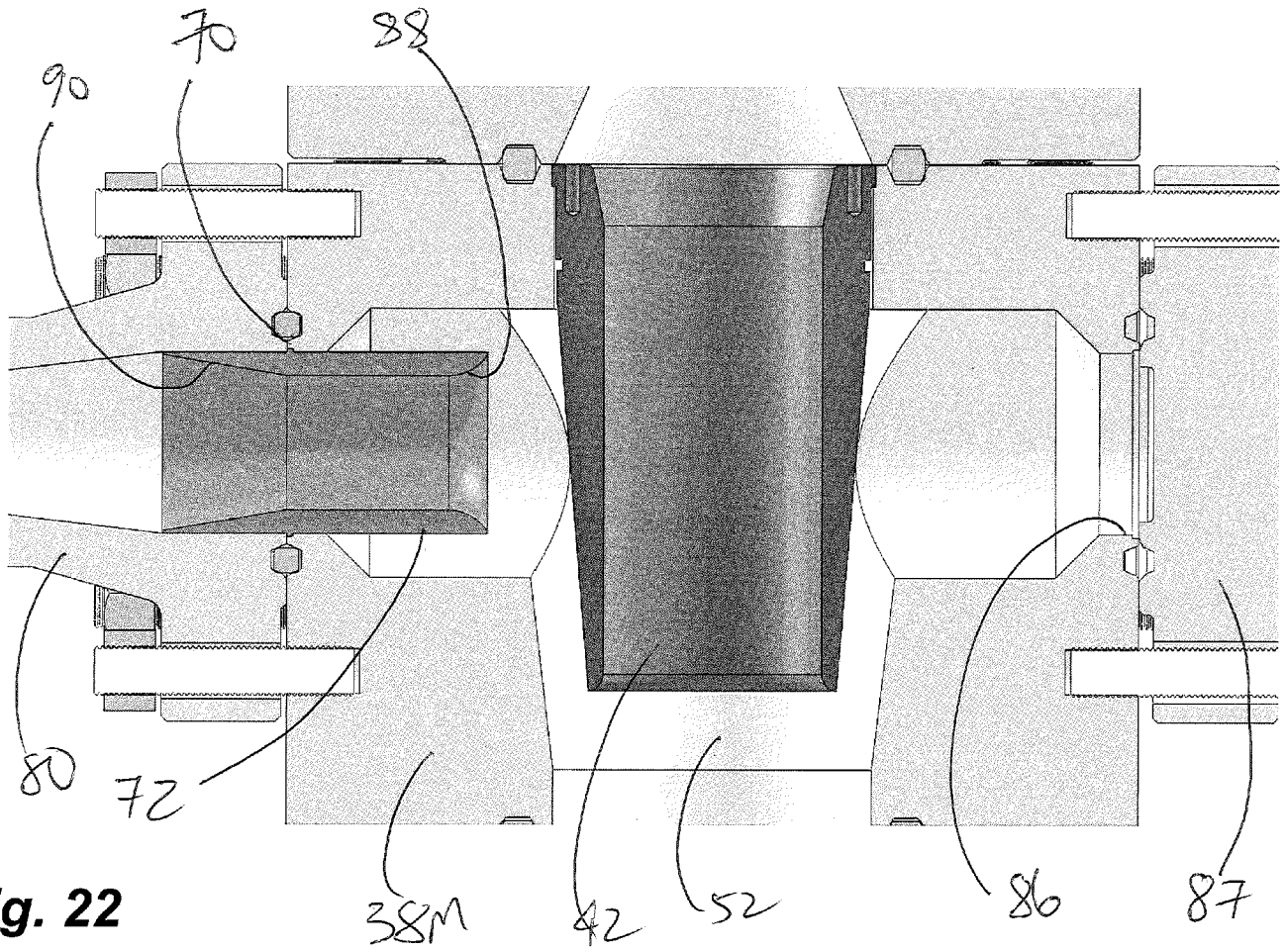
FIG. 22 illustrates a fracturing-flowback header having a main block having a deflection insert in the main bore, an outflow port insert and a blind flange fit to a spare port.

As shown in FIG. 20A, a flowback sleeve insert 72 is fit to the outlet port 70 for bridging the interface between the block and connecting discharge piping 80. The sleeve 72 is retained to the block 38M. As shown in FIG. 20B, one form of retainer is a circumferential flange 54 about the sleeve 72 and located intermediate along its length, such as that used in the case of the screen inlet 12 as shown in FIGS. 7A and 7B. A flange 85 of the connecting piping 80 sandwiches the circumferential flange 54 between the flange 85 and block 38M. As shown in FIG. 22, a fourth port 86 is fit with a blind flange 87

The sleeve 72 has an outer diameter fit to the diameter of the outlet port 70. A sleeve inlet 88 receives flowback FB. An optional bellmouth form of inlet 88 aids in flow dynamics. A sleeve outlet discharges flowback FB at a sleeve outlet 90 to the connecting piping 80. As shown in FIG. 20B, in the case of a valve 80V, the valve diameter is similar to that of the outlet port 70, accordingly, the sleeve 72 has an inside diameter or bore that is tapered to the sleeve outlet 90 to enlarge to substantially match that of the valve 80V.

Figures 21A, 21B, 21C:
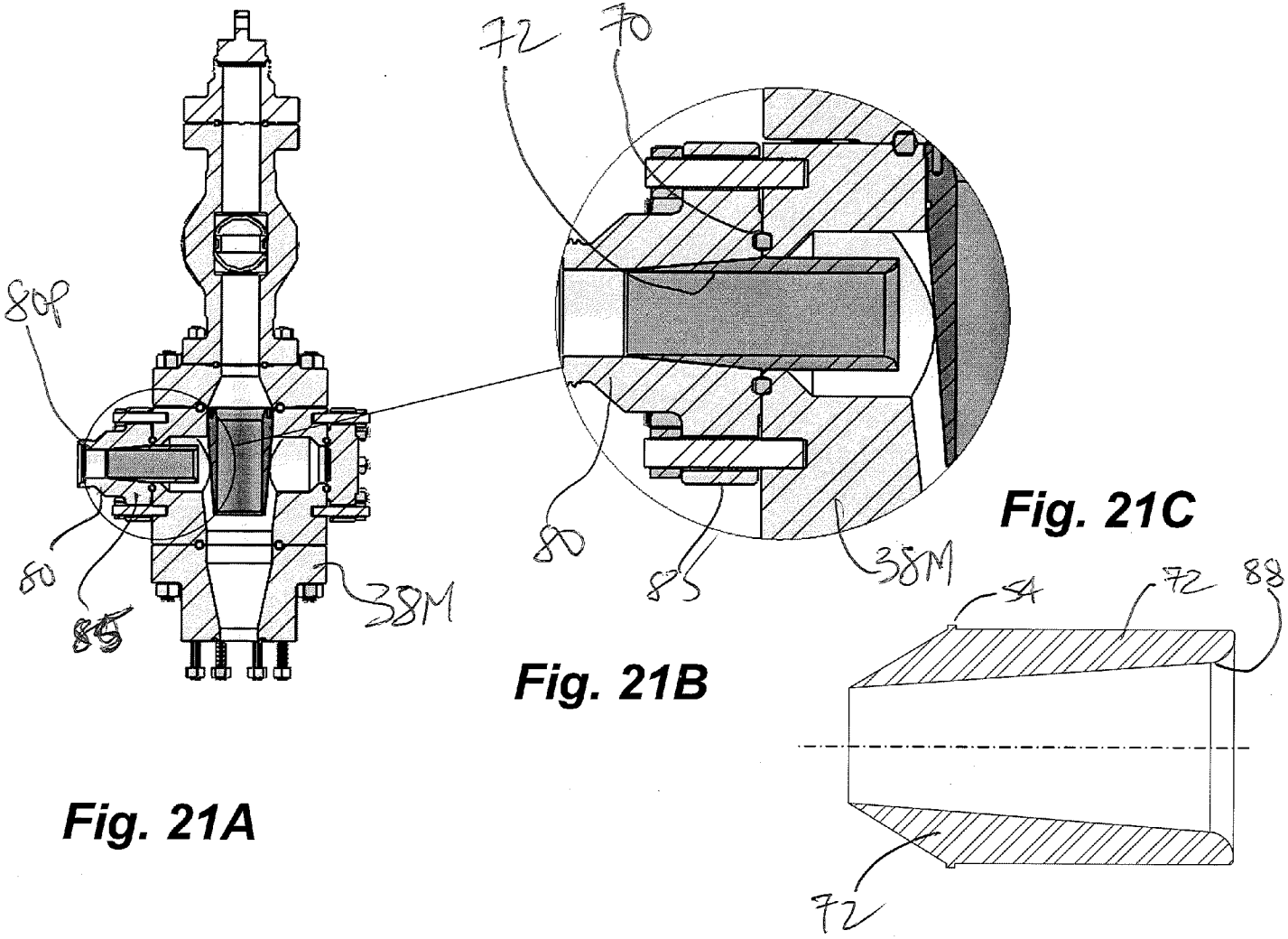
FIG. 21A is a cross-section of a fracturing-flowback header, sectioned transverse to the inlet ports to illustrate the flowback outlet, outflow sleeve connecting piping and a blind flange on an unused port.
FIG. 21B is a close-up of the outflow sleeve to the connecting piping valve of FIG. 21A, the connecting piping having a smaller throughbore diameter than that of the outflow port.
FIG. 21C is an embodiment of an outflow sleeve having a taper bore to adapt to smaller diameter outflow connections.

With reference to FIGS. 21A and 21B, when the flowback outlet port 70 is connected to piping 80P, the inside diameter of the piping is typically smaller than that of the block ports. Accordingly, considering the wall thickness of the sleeve insert 72, the outer diameter of the sleeve outlet 90 is tapered to accommodate the smaller sleeve outlet 90. This can also be accomplished in whole or in part with modification of an adapter flange 85 to incorporate a tapered bore. Accordingly, the change in diameter can be managed by a more gradual taper upon both the outer diameter of the sleeve 72 and the inside diameter of the adapter flange 85. As shown, the sleeve insert 72 can have an inside diameter about the same diameter as the piping 80P. While examples are presented herein of a valve 80V having a same inside diameter as the outlet port, and a connecting pipe having a smaller inside diameter, the principles of tapered inside and taper outside diameters are employed to minimize flow disruption. As shown in FIG. 21C, both the outer diameter of the sleeve outlet 90 and the inside diameter can be varied to match the diameter of the block outlet port 70 and the diameter of the connecting piping 80.

Deflector Screen

Figure 23A:
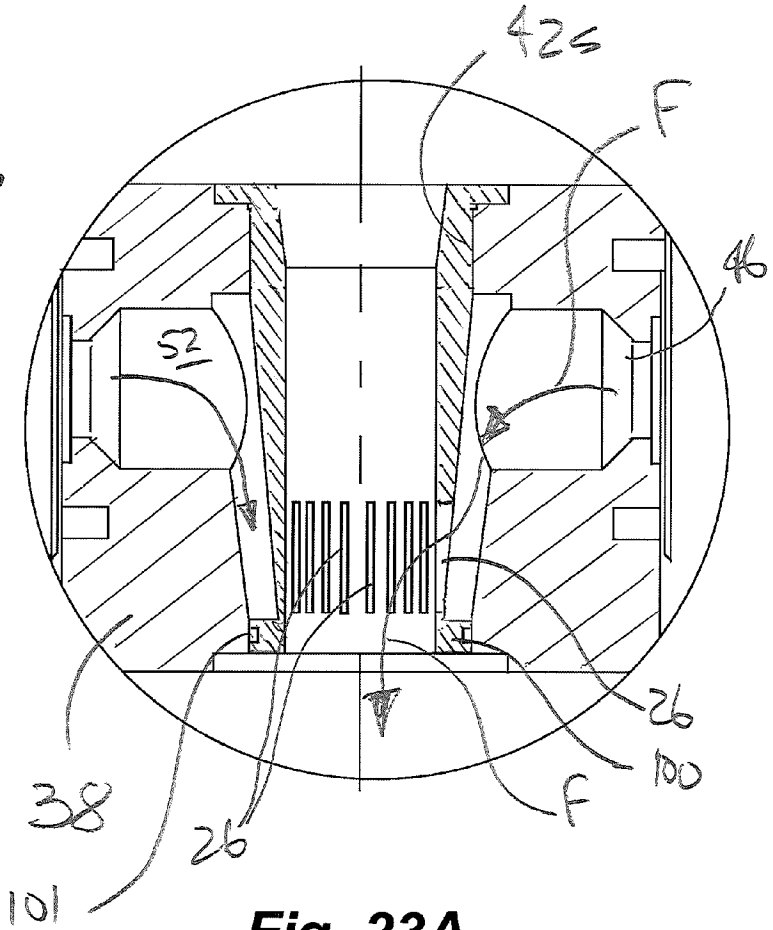
FIG. 23A illustrates a partial side cross-sectional view of a fracturing block having a deflector screen fit with the slot-like openings, spaced axially downhole from the inlet ports.
Figure 23B:
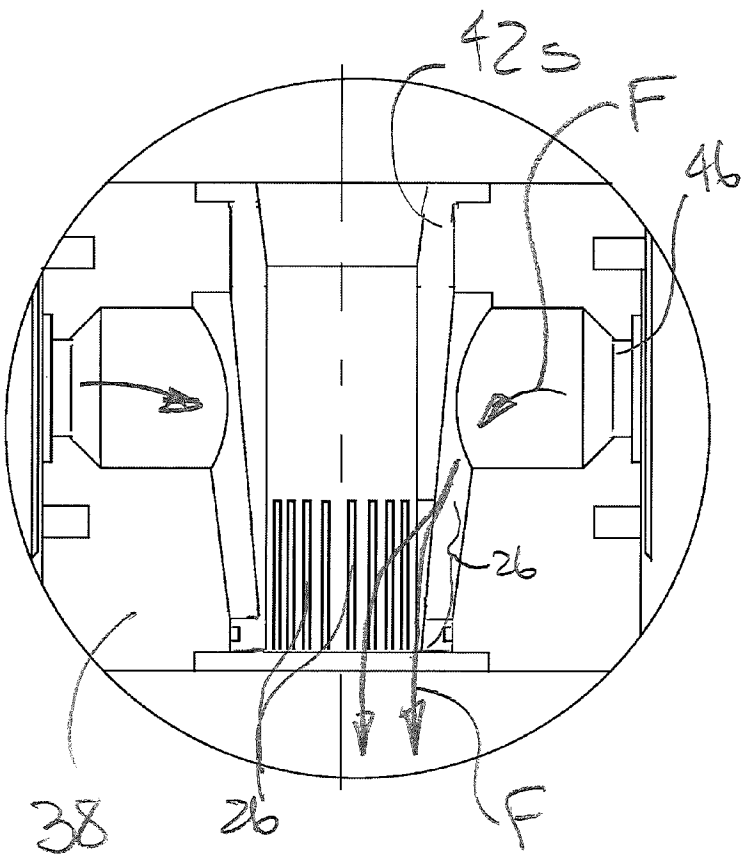
FIG. 23B is illustrates a partial side cross-sectional view of another embodiment of a fracturing block having a deflector screen, the plurality of openings extending axially through the bottom flange.

With reference to FIGS. 23A and 23B, in another embodiment, the deflector sleeve 42 can be a deflector screen 42*s* fit with the slot-like openings 26. In this case, the deflector screen is a tubular sleeve that fits to the main bore 52 top and bottom of the block 38. A plurality of openings 26 are formed and spaced about the circumference of the deflector screen permitting flow F to pass through the deflector screen and continue downhole to the wellbore. The form and method of forming and spacing the openings is as discussed above for the screen inserts.

In FIG. 23A, the deflector screen 42*s* is a tapered tubular having a solid profile opposing the inlet ports 46 for protecting coil tubing and other tool components passing therethrough. The plurality of openings 26 are vertically spaced or offset downhole so as to only receive the flow of fluid once the energy has been dissipated. The deflector screen has a lower flange 100 that slidable engages the main bore 52 and can seal thereto with an O-ring 101 or the like.

In FIG. 23B, the plurality of openings 26 are slotted through the flange 100 for an additional axial flow through component.

The embodiments of the invention for which an exclusive property or privilege is claimed are defined as follows:

1. A fracturing block for a fracturing header for delivering fracturing fluid to a wellbore comprising:

a main bore contiguous with the wellbore; and at least two opposing inlet ports in fluid communication with the main bore in communication with the wellbore, each of which receives a flow of fluid from a connecting conduit and discharges the fluid to the main bore for delivery to the wellbore, each inlet port having a screen insert fit thereto, each insert having a screen body having a tubular wall and an insert bore extending longitudinally therethrough, the insert bore having a downstream endwall thereacross and an open upstream inlet in fluid communication with the flow of fluid, and a plurality of openings extending through the tubular wall in fluid communication with the main bore, the openings being spaced circumferentially thereabout for discharging the flow of fluid to the main bore.

2. The fracturing block of claim 1 wherein each inlet port is arranged substantially perpendicular to the main bore.

3. The fracturing block of claim 1 further comprising an annular flow area about the screen insert's tubular wall, the annular flow area having a diameter greater than that of the tubular wall for passing the flow of fluid from the screen openings to the main bore.

4. The fracturing block of claim 3 wherein a net cross-sectional annular area of the annular flow area about the screen insert is greater than that of the sleeve bore.

5. The fracturing block of claim 1 wherein the endwall comprises a flat endwall.

6. The fracturing block of claim 1 wherein the endwall comprises a right conical wall having an apex directed to the open upstream fluid inlet for directing fracturing fluid from a generally axial flow through the sleeve bore to an angularly outward flow into the annular recess.

7. The fracturing block of claim 1 wherein the slot outlets are profiled to minimize disruption of the flow of fluid therethrough.

8. The fracturing block of claim 1 wherein the main bore is sized to receive wellbore tools therethrough.

9. The fracturing block of claim 1 wherein the main bore is sized to pass coil tubing.

10. The fracturing block of claim 1 wherein the fracturing block further comprises a deflector sleeve fit coaxially to the main bore.

11. The fracturing block of claim 10 wherein the deflector sleeve is sized to receive wellbore tools therethrough.

12. The fracturing block of claim 1 wherein the open upstream inlet has an inlet diameter substantially that of the connecting conduit.

13. The fracturing block of claim 12 wherein the screen bore is tapered intermediate the upstream inlet end and the openings.

14. A fracturing header comprising the fracturing block of claim 1.

15. A fracturing header comprising the fracturing block of claim 1 and a flowback block.

16. A fracturing header wherein the fracturing block of claim 1 further comprises a flowback outlet port; wherein the fracturing block comprises two opposing inlet ports for receiving the flow of fluid from the connecting conduit; and the flowback outlet port is in communication with the main bore for discharging flowback fluid from the main bore.

17. The fracturing header of claim 16 wherein the flowback outlet port is fit with a wear sleeve.

18. The fracturing header of claim 17 wherein the wear sleeve bridges an interface between the block and a discharge connection.

19. The fracturing header of claim 18 wherein the wear sleeve comprises a circumference flange located intermediate along its length; and the circumferential flange being retained between the block and the discharge connection.

20. A fracturing header for a wellbore comprising:

a multipurpose block having a main bore in communication with the wellbore, the multipurpose block further comprising:

two or more inlet ports disposable in opposing pairs and in communication with the main bore, each inlet port being fit with an insert, each insert having a tubular wall and an insert bore extending longitudinally therethrough, the insert bore having a downstream endwall thereacross and an open upstream fluid inlet in fluid communication with a flow of fracturing fluid, and one or more slot-like openings extending through the tubular wall and spaced circumferentially thereabout for discharging the flow of fluid to the main bore; and flowback outlet ports in communication with the main bore for receiving a flow of fluid from the main bore.

21. The fracturing header of claim 20 wherein the main bore is fit with deflector sleeve.

22. The fracturing header of claim 20 wherein the flowback outlet port is fit with a wear sleeve.

23. The fracturing header of claim 22 wherein the wear sleeve bridges an interface between the block and a discharge connection.

24. The fracturing header of claim 22 wherein the wear sleeve comprises a circumference flange located intermediate along its length; and the circumferential flange being retained between the block and the discharge connection.

25. Apparatus disposable in a fluid conduit upstream of a fracturing header, between a source of a flow of fracturing fluid and a wellbore, comprising:

a tubular wall defining a screen bore extending longitudinally therethrough, a plurality of openings spaced about a circumference of the tubular wall excluding debris entrained within the flow of fluid while permitting the fracturing fluid to pass therethrough between the screen bore and an annular flow area about the tubular wall, a closed endwall oriented upstream in the flow of fluid, blocking the screen bore and directing fluid through the plurality of openings substantially free of the debris, and an open end in fluid communication with the fracturing header, for flow of fluid between screen bore and the fluid conduit.

26. The apparatus of claim 25 wherein the apparatus is disposable in an equalization header upstream of the fracturing header.

27. The apparatus of claim 26 wherein the equalization header includes a cleanout for periodic removal of excluded debris.

28. The apparatus of claim 25 wherein:

the apparatus is disposable in a fracturing header;

the open end is oriented upstream to receive the flow of fluid and is in fluid communication with the source of fluid; and the closed endwall is oriented downstream.

29. The apparatus of claim 28 wherein the apparatus is a screen insert, two or more of which are disposable in opposing pairs, each in an opposing inlet port of a fracturing block of the fracturing header, the fracturing block having a main bore in fluid communication with the wellbore;

each screen insert having an annular flow area thereabout for fluid communication between the plurality of openings and the main bore.

30. The apparatus of claim 29 wherein the two or more screen inserts are two pairs of opposing screen inserts.

31. The apparatus of claim 30 wherein the first pair of screen inserts has a first flow capacity and the second pair of screen inserts has a second flow capacity.

32. The apparatus of claim 29 wherein a first pair of screen inserts are fit to first and second inlet ports for conducting the flow of fluid to the wellbore and a third outlet port conducts flowback from the wellbore.

33. The apparatus of claim 32 wherein the third outlet is fit with a wear sleeve.

34. A system for delivering fracturing fluid, substantially free of debris to a wellbore, comprising:

a fracturing block having a main bore connected to the wellbore and two or more fluid inlet ports for receiving fracturing fluid therein; and a screen insert fit to each of the two or more inlet ports, each insert comprising a tubular wall and an insert bore extending longitudinally therethrough, the insert bore having a downstream endwall thereacross and an open upstream fluid inlet in fluid communication with a flow of fracturing fluid, and a plurality of slot-like openings spaced circumferentially about and extending through the tubular wall for discharging the flow of fluid to the main bore.

35. The system of claim 34 further comprising a deflector sleeve fit to the main bore.

36. The system of claim 34 further comprising:

an equalization header upstream of the fracturing block and having two or more discharge outlets for distributing flow to each of the two or more inlet ports, and a screen insert fit to each of the two or more discharge outlets, each insert comprising a tubular wall and an insert bore extending longitudinally therethrough, the insert bore having an upstream endwall thereacross and an open downstream fluid outlet in fluid communication with a respective inlet port, and a plurality of slot-like openings spaced circumferentially about and extending through the tubular wall for screening the flow of fluid to the fracturing header.

* * * * *